US006171774B1

(12) United States Patent
Hiyama et al.

(10) Patent No.: US 6,171,774 B1
(45) Date of Patent: Jan. 9, 2001

(54) SILVER HALIDE PHOTOGRAPHIC LIGHT-SENSITIVE MATERIAL

(75) Inventors: Kunimasa Hiyama; Kazuhiro Murai, both of Odawara (JP)

(73) Assignee: Konica Corporation (JP)

( * ) Notice: Under 35 U.S.C. 154(b), the term of this patent shall be extended for 0 days.

(21) Appl. No.: 09/189,194

(22) Filed: Nov. 9, 1998

(30) Foreign Application Priority Data

Nov. 13, 1997 (JP) ..... 9-311925

(51) Int. Cl.[7] ..... G03C 1/08; G03C 7/26; G03C 7/32

(52) U.S. Cl. ..... 430/551; 430/557; 430/546; 430/627; 430/630; 430/631

(58) Field of Search ..... 430/543, 551, 430/557, 546, 627, 630, 631

(56) References Cited

U.S. PATENT DOCUMENTS

| | | | | |
|---|---|---|---|---|
| 4,006,025 | * | 2/1977 | Swank et al. | 430/449 |
| 4,957,857 | * | 9/1990 | Chari | 430/546 |
| 5,087,554 | * | 2/1992 | Chari et al. | 430/627 |
| 5,256,527 | * | 10/1993 | Chari et al. | 430/627 |

* cited by examiner

*Primary Examiner*—Geraldine Letscher
(74) *Attorney, Agent, or Firm*—Jordan B. Bierman; Bierman, Muserlian and Lucas

(57) ABSTRACT

A silver halide photographic light sensitive material is disclosed. The light-sensitive material comprises a support having thereon a yellow dye image-forming emulsion layer, a magenta dye image-forming emulsion layer, and a cyan dye image-forming emulsion layer and optionally a light-insensitive layer, in which said yellow image-forming emulsion layer contains a yellow dye-forming coupler represented by Formula I and an organic solvent-soluble polymer, and a light-sensitive or light-insensitive layer each adjoined to the yellow image forming emulsion layer contains a polymer which have a constituting unit represented by Formula II;

Formula I wherein $R_A$ is an alkyl group or a cycloalkyl group, $R_B$ is a halogen atom or an alkoxy group, $R_C$ is a group capable of being a substituent of the benzene group, m is an integer of from 0 to 40, and Z is a releasing group;

Formula II

10 Claims, No Drawings

SILVER HALIDE PHOTOGRAPHIC LIGHT-SENSITIVE MATERIAL

FIELD OF THE INVENTION

This invention relates to a silver halide photographic light-sensitive material, and particularly relates to that having an excellent image storage ability and stably giving a high maximum density and a suitable whiteness of the background of image.

Silver halide photographic light-sensitive materials, particularly silver halide color photographic materials are usually used since those have a high sensitivity and an excellent gradation reproducibility.

Recently, in the field of photography, a demand to reduce the amount of processing solution or a replenishing solution to be used for processing a silver halide photographic material is strongly raised from the viewpoint of environmental suitability. Accordingly, a silver halide photographic material and a processing method are required, by which a high quality of image can be obtained even when the light-sensitive material is processed by such the processing condition.

Besides, an image formed on a silver halide photographic material is desired to maintain a high quality after a prolonged storage, and it has been a long standing thema in the field of photography to raise the light-fastness of image.

It has been tried to raise the concentration of color developing agent in the processing solution for reducing the amount of the processing solution or the replenishing solution. However, the simple increasing of the processing solution concentration causes a problem of an unnecessary color formation in the unexposed area or an increasing in fogging.

On the other hand, an addition of an antioxidant or a high molecular weight substance has been tried to raise the light-fastness of image formed in the silver halide photographic material. In such the case, the maximum density of the image tends to be reduced when the object is attained by the simply use of the additives. Moreover, the suitable image quality cannot be stably obtained when the light-sensitive material is processed by the foregoing processing with a reduced amount of the processing solution or the replenishing solution.

SUMMARY OF THE INVENTION

The object of the invention is to provide a silver halide photographic light-sensitive material by which an image having a high light-fastness and a high quality image having a lowered fogging can be stably obtained with a high color forming efficiency even if conditions of the processing solution is variously changed, and the fog increasing in the course of storage of the raw light-sensitive material is sufficiently inhibited.

The above object of the invention is attained by a silver halide photographic light sensitive material comprising a support having thereon a yellow dye image-forming light-sensitive silver halide emulsion layer, a magenta dye image-forming light-sensitive silver halide emulsion layer, and a cyan dye image-forming light-sensitive silver halide emulsion layer and optionally a light-insensitive layer, in which said yellow image-forming light-sensitive silver halide emulsion layer contains a yellow dye-forming coupler represented by Formula I and an organic solvent-soluble polymer, and the light-sensitive or light-insensitive layer adjoined with the yellow image forming silver halide emulsion layer contains a polymer which have a constituting unit represented by Formula II;

Formula I

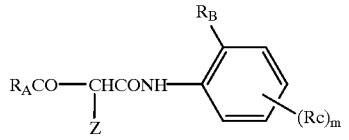

wherein $R_A$ is an alkyl group or a cycloalkyl group, $R_B$ is a halogen atom or an alkoxy group, $R_C$ is a group capable of being a substituent of the benzene group, m is an integer of from 0 to 40, when m is 2 or more the plural $R_c$,s may be the same or different from each other, and Z is a group capable of being released upon reaction with the oxidation product of a color developing agent, Formula II

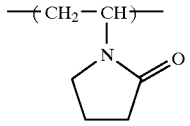

DETAILED DESCRIPTION OF THE INVENTION

The silver halide photographic light-sensitive material of the invention, herein after referred to the light-sensitive material of the invention, contains a yellow dye-forming coupler represented by Formula I, hereinafter referred to a yellow dye-forming coupler of the invention.

In the light-sensitive material of the invention contains a yellow dye-forming coupler represented by Formula I in the yellow dye image forming emulsion layer thereof.

Formula I

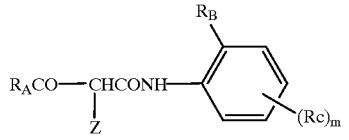

In Formula I, the alkyl group represented by $R_A$ includes a straight- and a branched-chain alkyl group such as a methyl group, an ethyl group, an i-propyl group, a t-butyl group, a dodecyl group and a 1-hexyl group, and the cycloalkyl group represented by $R_A$ includes a cyclopropyl group, a cyclohexyl group and an adamantyl group.

The alkyl group and the cycloalkyl group each may have a substituent. Examples of the substituent include the followings: a halogen atom such as a chlorine atom and a bromide atom, a cyano group, a nitro group, an aryl group such as a phenyl group, p-t-octylphenyl group and a 2,4-di-t-amylphenyl group, a hydroxyl group, an alkoxy group such as a methoxy group and a 2-ethoxyethoxy group, an aryloxy group such as a phenoxy group, a 2,4-di-t-amylphenoxy group and a 4-(4-hydroxyphenyl-sulfonyl)phenoxy group, a heterocyclic oxy group such as a 4-pyridyloxy group and a 2-hexahydropyranyloxy group, a carbonyloxy group, for example, an alkylcarbonyloxy group such as an acetyloxy group and a pivaloyloxy group, and an arylcarbonyloxy group such as a benzoyloxy group, a sulfonyloxy group, for example, an alkylsulfonyl group such as a methanesulfonyloxy group, a trifluoromethanesulfonyloxy group and an n-dodecanesulfonyloxy group, and an arylsulfonyloxy group such as benzenesulfonyloxy group and a p-toluenesulfonyloxy group, a carbonyl group, for example an alkylcarbonyl group such as an acetyl group and a pivaloyl group, and an arylcarbonyl group such as a benzoyl group and 3,5-di-t-butyl-4-hydroxybenzoyl group, an oxycarbonyl group, for example, an alkoxycarbonyl group such as methoxycarbonyl group and a cyclohexyloxycarbonyl group and a and an n-dodecyloxycarbonyl group, and an aryloxycarbonyl group such as phenoxycarbonyl group, a 2,4-di-t-amylphenoxycarbonyl group and a 1-naphthyloxycarbonyl group, and a heterocyclic oxycarbonyl group such as 2-pyridyloxycarbonyl group and 1-phenylpyrazolyl-5-oxycarbonyl group, a carbamoyl group, for example, an alkylcarbonyl group such as a dimethylcarbamoyl group and a 4-(2,4-di-t-amylphenoxy)butylaminocarbamoyl group, and an arylcarbamoyl group such as a phenylcarbamoyl group and a 1-naphthyl-carbamoyl group, a sulfonyl group, for example, an alkylsulfonyl group such as a methanesulfonyl group and a trifluoromethanesulfonyl group, and an arylsulfonyl group such as a p-toluenesulfonyl group, a sulfamoyl group, for example, an alkylsulfamoyl group such as a dimethylsulfamoyl group and a 4-(2,4-di-t-amylphenoxy)butylaminosulfonyl group, and an arylsulfamoyl group such as phenylsulfamoyl group, an amino group, for example, an alkylamino group such as a dimethylamino group, a cyclohexylamino group and an n-dodecylamino group, and an arylamino group such as an anilino group and a p-t-octylanilino group, a sulfonylamino group, for example, an alkylsulfonylamino group such as a methanesulfonylamino group, a heptafluoropropanesulfonylamino group and an n-hexadecylsulfonylamino group, and an arylsulfonylamino group such as a p-toluenesulfonylamino group and a pentafluorobenzenesulfonylamino group, an acylamino group, for example, an alkylcarbonylamino group such as an acetylamino group and a myristoylamino group, and an arylcarbonylamino group such as a benzoylamino group, an alkylthio group such as a methylthio group and a t-octylthio group, an arylthio group such as a phenylthio group, and a heterocyclic thio group such as a 1-phenyltetrazole-5-thio group and a 5-methyl-1,3,4-oxathiadiazole-2-thio group.

As the group represented by $R_A$, a branched-alkyl group is preferable and a t-butyl group is particularly preferable.

As the alkoxy group represented by $R_B$, a straight- and branched-alkoxyl group such as a methoxy group, an ethoxy group, a 1-methylethyloxy group, a t-butyloxy group a dodecyloxy group and a 1-hexylnonyloxy group are suitable. Among them, a methoxy group is preferred.

As the halogen atom represented by $R_B$, for example, a chlorine atom, a bromine atom and a fluorine atom are cited, and a chlorine atom is preferred.

As the group represented by $R_C$ capable of being a substituent of the benzene ring, for example, the foregoing groups described as the substituent of the alkyl group or the cycloalkyl group represented by $R_A$ in Formula I are suitable.

In Formula I, m represents an integer of from 0 to 4, and when m is 2 or more, plural $R_c$s may be the same or different from each other. m is preferably 1, and the position of $R_C$ is preferably the 5-position of the anilide ring.

The group represented by $R_C$ capable of being a substituent of the benzene ring is preferably a group represented by —$COOR_{D1}$. The group represented $R_{D1}$ is a mono-valent organic group which is preferably a group functioning as an antidiffusion group, for example, a straight- or branched-chain alkyl group having 10 or more carbon atoms such as a dodecyl group and an octadecyl group, or an aryl group such as a 2,4-dipentylphenyl group. A straight- or branched-chain alkyl group having 14 or more carbon atoms is more preferable.

In Formula I, Z represents a group capable of being released from the coupler upon reaction with the oxidation product of a color developing agent, for example, a group represented by the following Formula VII.

Formula VII

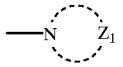

In Formula VII, $Z_1$ represents a group of no-metallic atoms necessary to form a 5- or 6-member ring together with the nitrogen atom. The examples of the group represented by $Z_1$ include a methylene group, a methine group, >C═O, >$NR_E$, —N═, —O—, —S— and —$SO_2$—, in which $R_E$ represents the group the same as the substituent of the foregoing $R_C$.

Preferably one of the group represented by $Z_1$ is —O—.

The yellow dye-forming coupler represented by Formula I can be synthesized by a well known method. Two or more kinds of the coupler represented by Formula I may be used in combination. The coupler represented by Formula I may be used in combination with a coupler other than the coupler represented by Formula I within the range in which the effect of the invention is not degraded. In the invention, the coating amount of the yellow coupler is preferably from $0.50\times10^{-3}$ moles to $1.10\times10^{-3}$ moles, more preferably from $0.60\times10^{-3}$ moles to $1.00\times10^{-3}$ moles, per square meter.

Examples of the yellow dye-forming coupler represented by Formula I are shown below.

I-1
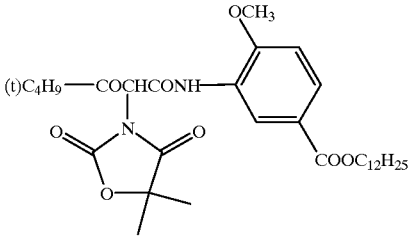
I-2
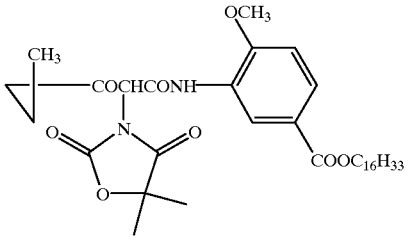
I-3
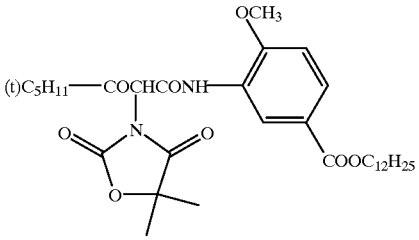
I-4
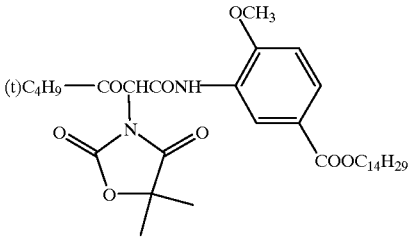
I-5
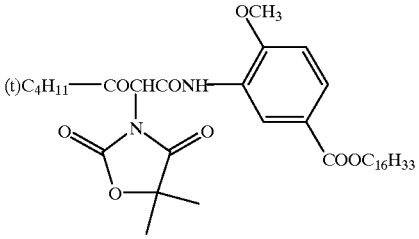
I-6
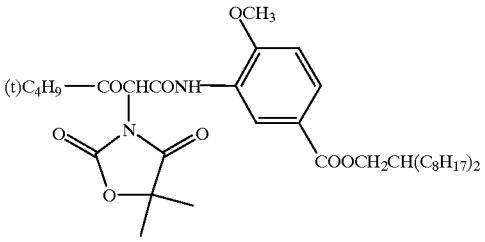
-continued
I-7
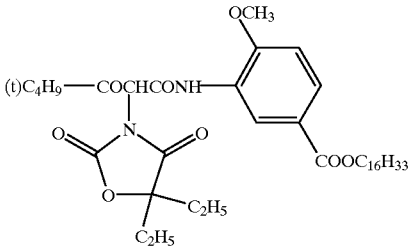
I-8
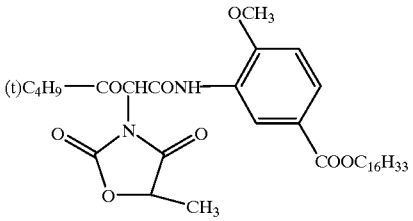
I-9
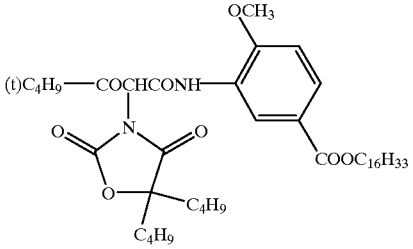
I-10
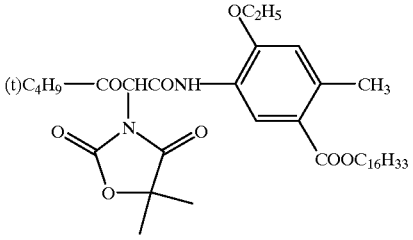
I-11
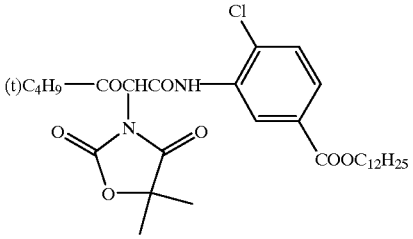
I-12
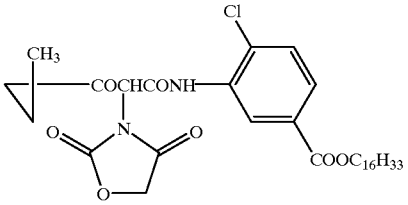

-continued
I-13
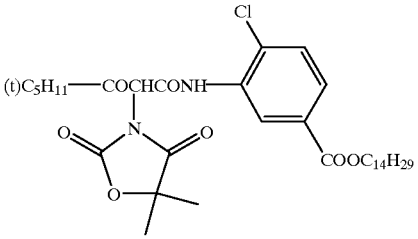
I-14
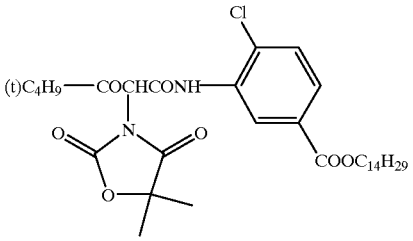
I-15
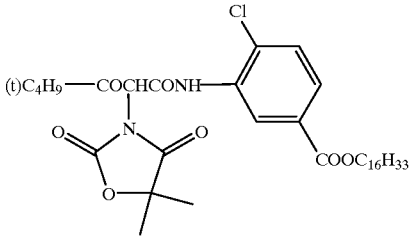
I-16
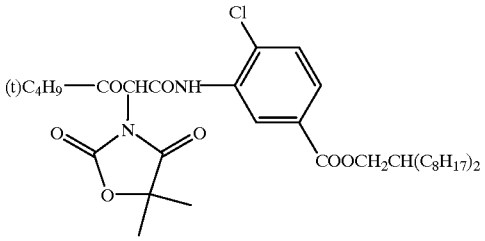
I-17
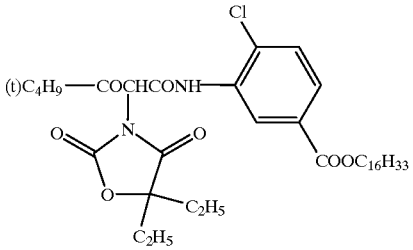
I-18
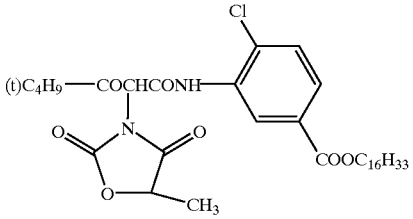
-continued
I-19
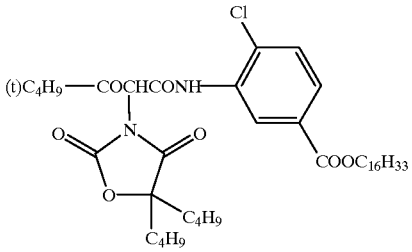
I-20
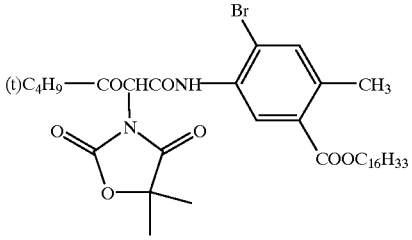
I-21
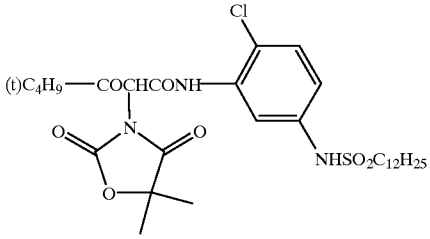
I-22
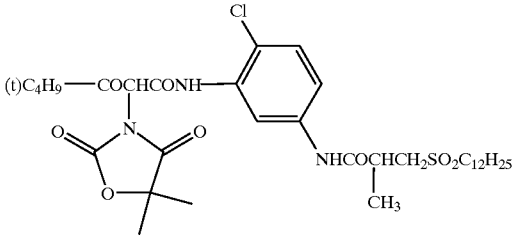
I-23
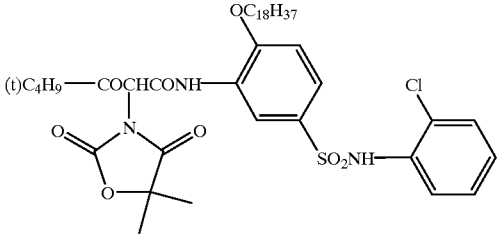
I-24
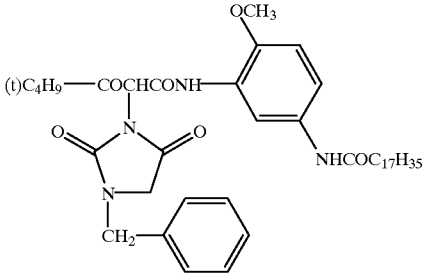

-continued
I-25
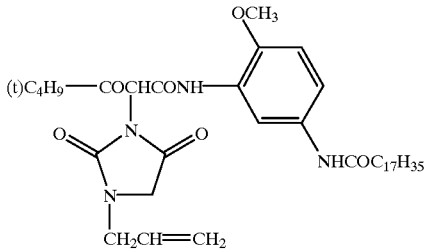
I-26
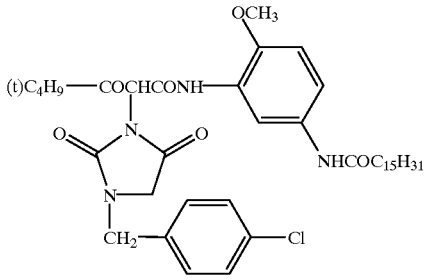
I-27
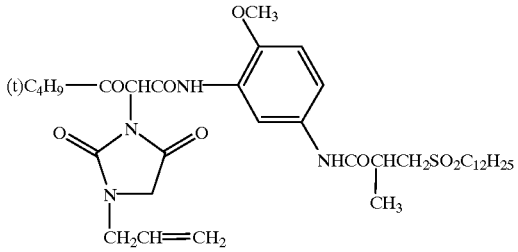
I-28
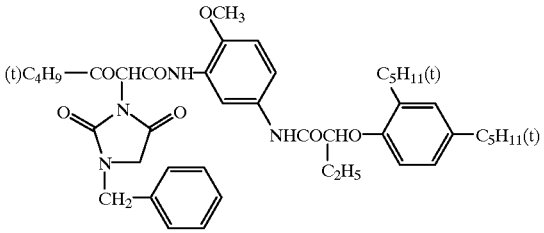
I-29
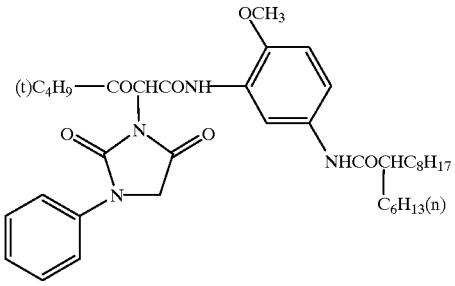
-continued
I-30
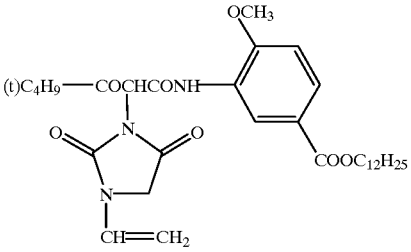
I-31
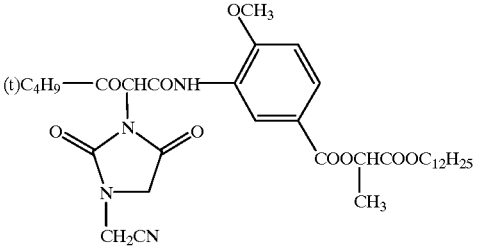
I-32
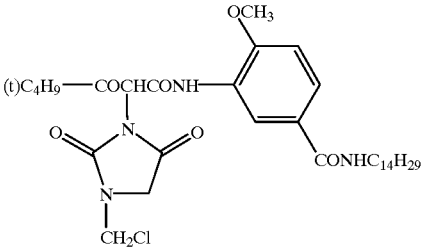
I-33
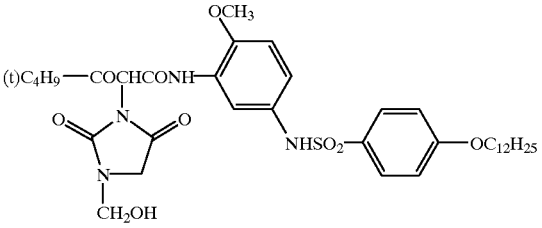
I-34
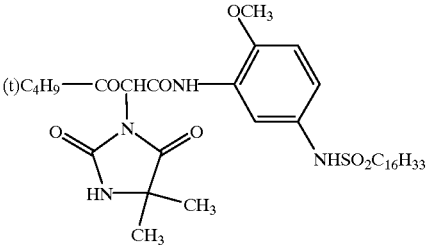
I-35
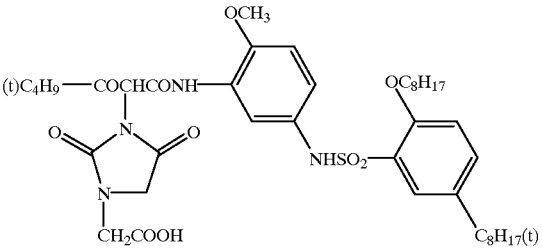

-continued
I-36
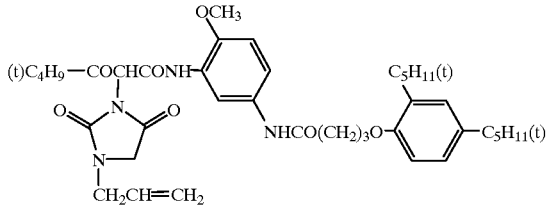
I-37
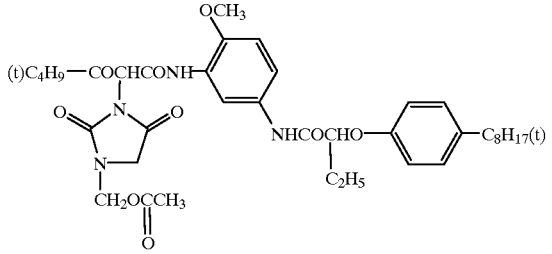
I-38
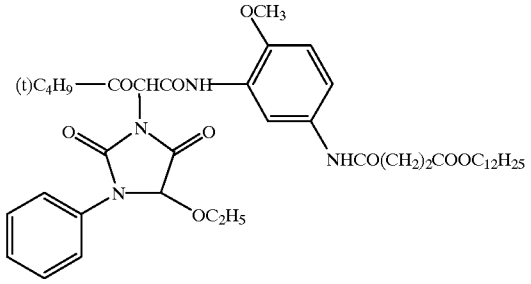
I-39
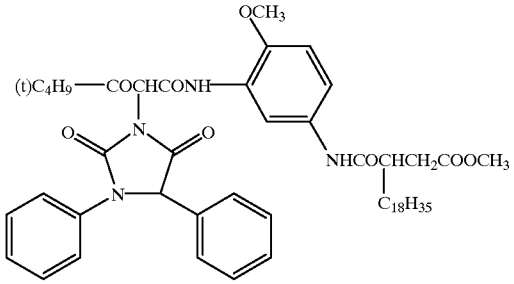
-continued
I-40
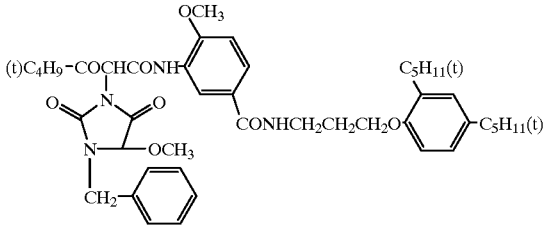
I-41
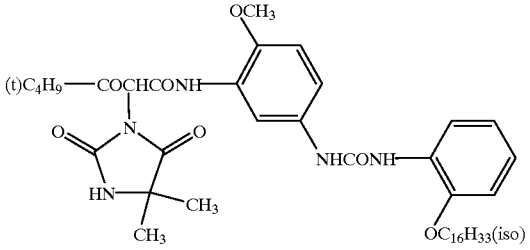
I-42
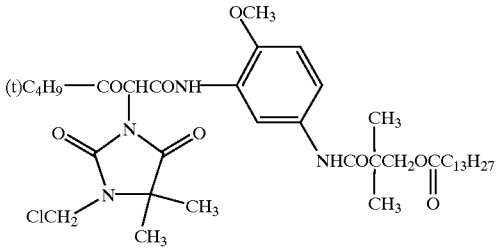
I-43
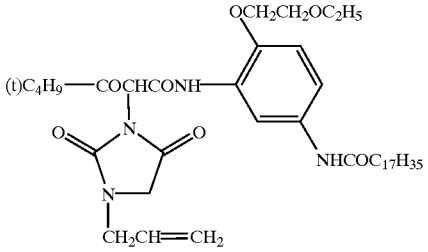
I-44
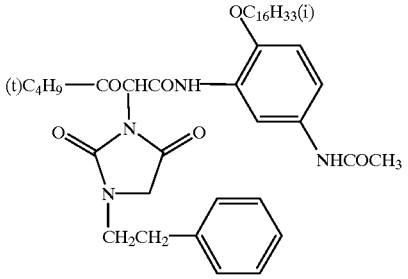

-continued

I-45

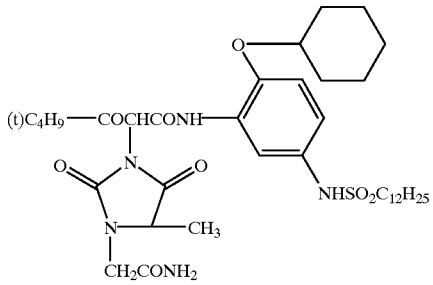

I-46

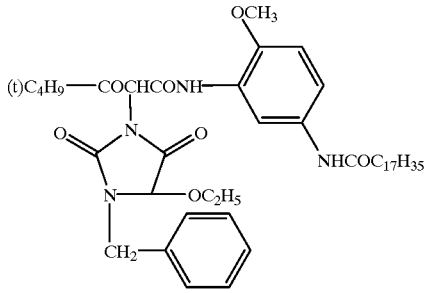

I-47

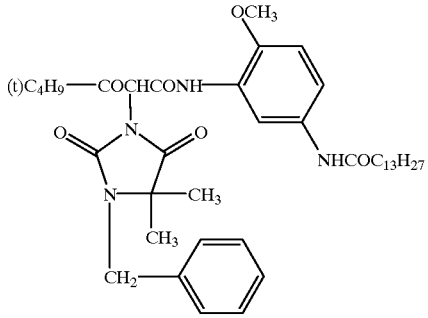

I-48

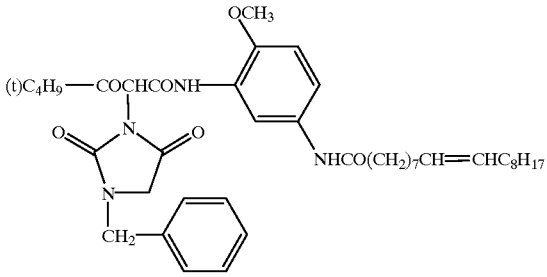

I-49

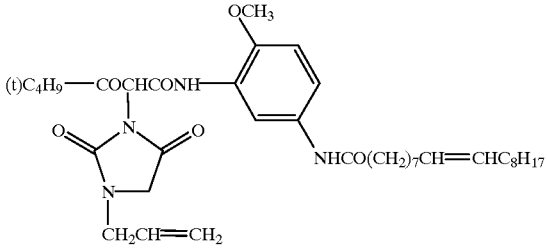

-continued

I-50

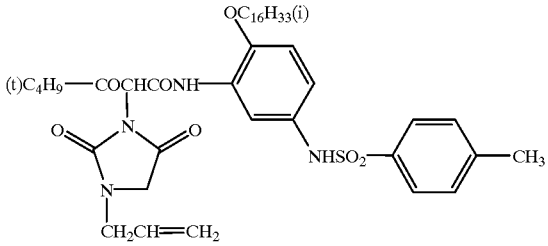

I-51

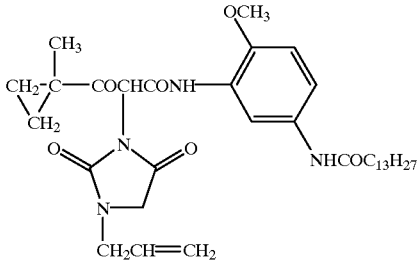

I-52

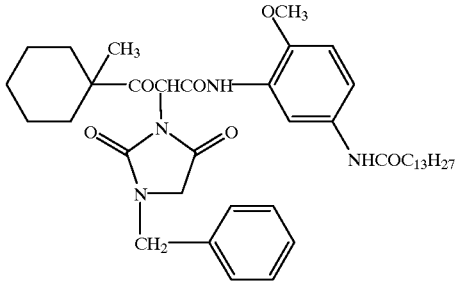

I-53

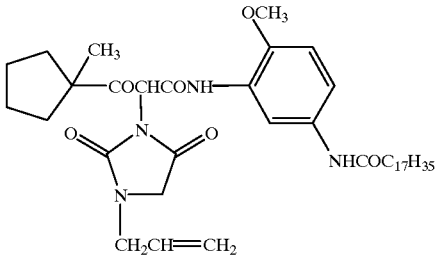

In the light-sensitive material of the invention, an organic solvent-soluble polymer is contained in the yellow image forming emulsion layer.

The organic solvent soluble-polymer is a polymer compound which is insoluble in water and soluble in an oil. The organic solvent-soluble polymer is preferably a polymer having a solubility of not more than 3 g, more preferably not more than 1 g, in 100 g of ethyl acetate.

The organic solvent soluble polymer usable in the invention includes (1) a vinyl polymer and a copolymer thereof, (2) a condensed polymer of a polyvalent alcohol and a polybasic acid, (3) a polyester obtained by a open-ring polymerization method, and (4) another polymer compound.

Each of these organic solvent-soluble polymers may be used in a form of aqueous latex by decorating with a hydrophilic group within the range in which the organic solvent-solubility thereof is not lost.

The polymers of the above (1) to (4) are described below.

(1) The vinyl polymer and the copolymer thereof

As the monomer for forming the vinyl polymer of the copolymer thereof, the followings are usable; an acrylic acid ester such as methyl acrylate, butyl acrylate, isopropyl acrylate, amyl acrylate, hexyl acrylate, 2-ethylhexyl acrylate, t-octyl acrylate, 2-chloroethyl acrylate, cyanoethyl acrylate, 2-acetoxyethyl acrylate, dimethylaminoethyl acrylate, methoxybenzyl acrylate and phenyl acrylate, a methacrylic acid ester such as methyl methacrylate, ethyl methacrylate, propyl methacrylate, butyl methacrylate, isopropyl methacrylate, amyl methacrylate, cyclohexyl methacrylate, benzyl methacrylate, octyl methacrylate, sulfopropyl methacrylate, phenyl methacrylate, cresyl methacrylate and 2-hydroxyethyl methacrylate, a vinyl ester such as vinyl acetate, vinyl propionate, vinyl butylate, vinyl isobutylate, vinyl chloroacetate, vinyl methoxyacetate, vinyl phenylacetate, vinyl benzoate and vinyl salicylate, an acrylamide such as acrylamide, ethylacrylamide, propylacrylamide, butylacrylamide, t-butylacrylamide, cyclohexylacrylamide, benzylacrylamide, hydroxymethylacrylamide, methoxyethylacrylamide, dimethyl-aminoethylacrylamide, phenylacrylamide, dimethylacrylamide and N-(2-hydroxy-5-ethylsulfonylphenyl) acrylamide, a methacrylamide such as methacrylamide, ethylmethacrylamide, ethylmethacrylamide, propylmethacrylamide, butylmethacrylamide, t-butylmethacrylamide, cyclohexylmethacrylamide, benzylmethacrylamide, hydroxymethylmethacrylamide, methoxyethyl-methacrylamide, dimethylmethacrylamide, dimethylaminoethyl-methacrylamide, phenylmethacrylamide and N-(3-hydroxyphenyl)-methacrylamide, an olefin such as dicyclopentadiene, ethylene, propylene, 1-butene, 1-pentene, butadiene, isoprene, chloroprene, vinyl chloride and vinylidene chloride, and a styrene such as styrene, methylstyrene, trimethylstyrene, ethylstyrene, chloromethylstyrene, methoxystyrene, chlorostyrene, dichlorostyrene and vinyl benzoate. Other than the above, the followings are usable; a crotonic acid ester such as butyl crotonate, a diester of itaconic acid such as diethyl itaconate, a diester of maleic acid such as dimethyl maleate, a diester of fumaric acid such as dimethyl fumarate, an allyl compounds such as allyl acetate, a vinyl ether such as methyl vinyl ether and methoxyethyl vinyl ether, a vinyl ketone such as methyl vinyl ketone, a vinyl heterocyclic compound such as vynylpyridine and N-vinyloxazolidone, a glycidyl ester such as glycidyl acrylate and an unsaturated nitryl compound such as acrylonitryl.

A homopolymer derived from the above-mentioned monomer is usable and a copolymer derived from two or more monomers may also be used according to necessity. The copolymer to be used in the invention may contain a monomer having the following acid group within the range in which the copolymer is not become water soluble. The content of the monomer having the acid group is preferably not more than 20 mole %, and one containing no monomer having acid group is more preferable.

As the monomer having an acid group, for example, the followings are usable; acrylic acid, methacrylic acid, itaconic acid, maleic acid, a monoalkyl itaconate, a monoalkyl maleate, citraconic acid, styrenesulfonic acid, vinylbenzylsulfonic acid, an acryloyloxyalkylsulfonic acid, a methacryloyloxyalkylsulfonic acid, an acryloylamidealkylsulfonic acid, a methacryloylamide-sulfonic acid, an acryloyloxyalkyl phosphate and a methacryloyloxyalkyl phosphate. These acids each may be a salt of alkali metal such as sodium and potassium or an ammonium ion.

The monomer for forming the organic solvent-soluble polymer to be used in the invention is preferably an acrylate, a methacrylate, an acrylamide and a methacrylamide.

The polymer formed by the foregoing monomers can be obtained by solution polymerization, bulk polymerization, suspension polymerization or latex polymerization. A water-soluble polymerization initiator and an oleophilic polymerization initiator are used in these polymerization methods. As the water-soluble initiator, a persulfate such as potassium persulfate and sodium persulfate, a water soluble azo compound such as sodium 4,4'-azo-bis-4-cyanovalerate, a 2,2'-azo-bis(cyclohexanone-1-carbonitryl) and 2,2'-azo-bis(2-amidinopropane) hydrocholide, and hydrogen peroxide may be used. The oleophilic polymerization initiator includes, for example, an oleophilic azo compound such as azo-bis-isobutylonitryl, 2,2'-azo-bis(2,4-dimethylvaleronitrile), 1,1'-azo-bis(cyclohexanone-l-carbonitryl), dimethyl 2,2'-azo-bis-isolactate and diethyl 2,2'-azo-bis-isolactate, benzoyl peroxide, lauryl peroxide, diisopropyl peroxydicarbonate and di-t-butyl peroxide.

(2) The polyester resin formed by condensation of a polyvalent alcohol and a polybasic acid As the polyvalent alcohol, a glycol having a structure of HO—$R_1$—OH, in which $R_1$ is a hydrocarbon chain, particularly an aliphatic hydrocarbon chain having from 2 to about 12 carbon atoms, or a polyalkylene glycol are suitable. As the polybasic acid, one having a structure of HOOC—$R_2$—COOH is suitable, in which $R_2$ is a simple bonding or a hydrocarbon chain having from 1 to 12 carbon atoms.

Examples of the polyvalent alcohol include ethylene glycol, diethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,8-octanediol, 1,9-nonanediol, 1,10-decanediol, glycerol, diglycerol, triglycerol, 1-methylglycerol, erythritol, mannitol and solbitol.

Examples of the polybasic acid include oxalic acid, succinic acid, glutaric acid, adipic acid, pimelic acid, cork acid, azelaic acid, sebacic acid, decanedicarxoylic acid, dodecanedicarboxylic acid, fumalic acid, maleic acid, itaconic acid, citraconic acid, phthalic acid, isophthalic acid, terephthalic acid, tetrachlorophthalic acid, itaconic acid, isopimelic acid, a cyclopentadiene-maleic anhydride adduct, a rosin-maleic anhydride adduct.

(3) The polyester formed by open-ring polymerization method

The polyester can be formed by, for example, β-propiolactone, ϵ-caprolactone or dimethylpropiolactone.

(4) The other polymer

A novolac resin, a polycarbonate resin formed by condensation-polymerization of a glycol or a divalent phenol and a carbonate or phosgene, a polyurethane resin formed by addition-polymerization of a polyvalent alcohol and a polyvalent isocyanate, and a polyamide resin formed by a polyvalent amine and a polybasic acid are usable.

Although the molecular weight of the polymer to be used in the invention is not specifically limited, a molecular weight of not more than 200,000 is preferable and a molecular weight of from 5,000 to 100,000 is more preferable.

The weight ration of the polymer to the yellow dye forming coupler is preferably from 1:20 to 20:1, more preferably 1:10 to 10:1.

Concrete examples of the polymer to be used in the invention are shown below, in which the composition of the copolymer is described in the weight ratio. The polymer usable in the invention is not limited thereto.

| | |
|---|---|
| P-1 | Poly(N-secd-butylacrylamide) |
| P-2 | Poly(N-t-butylacrylamide) |
| P-3 | Diacetoneacrylamide/methyl methacrylate copolymer (25:75) |
| P-4 | Poly(cyclohexyl methacrylate) |
| P-5 | N-t-butylacrylamide/methyl methacrylate copolymer (60:40) |
| P-6 | Poly(N,N-dimethylacrylamide) |
| P-7 | Poly(t-butyl methacrylate) |
| P-8 | Poly(vinyl acetate) |
| P-9 | Poly(vinyl propionate) |
| P-10 | Poly(methyl methacrylate) |
| P-11 | Poly(ethyl methacrylate) |
| P-12 | Poly(ethyl acrylate) |
| P-13 | Vinyl acetate/vinyl alcohol copolymer (90:10) |
| P-14 | Poly(butyl acrylate) |
| P-15 | Poly(butyl methacrylate) |
| P-16 | Poly(isobutyl methacrylate) |
| P-17 | Poly(isopropyl methacrylate) |
| P-18 | Poly(octyl acrylate) |
| P-19 | Butyl acrylate/acrylamide copolymer (95:5) |
| P-20 | Stearyl methacrylate/acrylic acid copolymer (90:10) |
| P-21 | Methyl methacrylate/vinyl chloride copolymer (70:30) |
| P-22 | Methyl methacrylate/styrene copolymer (90:10) |
| P-23 | Methyl methacrylate/ethyl acrylate copolymer (50:50) |
| P-24 | Butyl methacrylate/methyl methacrylate/styrene copolymer (50:20:30) |
| P-25 | Vinyl acetate/acrylamide copolymer (85:15) |
| P-26 | Vinyl chloride/vinyl acetate copolymer (65:35) |
| P-27 | Methyl methacrylate/acrylonitril copolymer (65:35) |
| P-28 | Butyl methacrylate/pentyl methacrylate/ N-vinyl-2-pyrrolidone copolymer (38:38:24) |
| P-29 | Methyl methacrylate/butyl methacrylate/isobutyl methacrylate/acrylic acid copolymer (37:29:25:9) |
| P-30 | Butyl methacrylate/acrylic acid copolymer (95:5) |
| P-31 | Methyl methacrylate/acrylic acid copolymer (95:5) |
| P-32 | Benzyl methacrylate/acrylic acid copolymer (93:7) |
| P-33 | Butyl methacrylate/methyl methacrylate/benzyl methacrylate/acrylic acid copolymer (35:35:25:5) |
| P-34 | Butyl methacrylate/methyl methacrylate/benzyl methacrylate copolymer (40:30:30) |
| P-35 | Diacetoneacrylamide/methyl methacrylate copolymer (50:50) |
| P-36 | Methyl vinyl ketone/isobutyl methacrylate copolymer (55:45) |
| P-37 | Ethyl methacrylate/butyl acrylate copolymer (70:30) |
| P-38 | Diacetoneacrylamide/butyl acrylate copolymer (60:40) |
| P-39 | Methyl methacrylate/styrene methacrylate/ diacetoneacrylamide copolymer (40:40:20) |
| P-40 | Butyl acrylate/styrene methacrylate/diacetoneacrylamide copolymer (70:20:10) |
| P-41 | Stearyl methacrylate/methyl methacrylate/acrylic acid copolymer (50:40:10) |
| P-42 | Methyl methacrylate/styrene/vinylsulfonamide copolymer (70:20:10) |
| P-43 | Methyl methacrylate/phenyl vinyl ketone copolymer (70:30) |
| P-44 | Butyl acrylate/methyl methacrylate/butyl methacrylate copolymer (35:35:30) |

-continued

| | |
|---|---|
| P-45 | Butyl methacrylate/N-vinyl-2-pyrrolidone copolymer (90:10) |
| P-46 | Poly(pentyl acrylate) |
| P-47 | Cyclohexyl methacrylate/methyl methacrylate/propyl methacrylate (37:29:34) |
| P-48 | Poly(pentyl methacrylate) |
| P-49 | Methyl methacrylate/butyl methacrylate copolymer (65:35) |
| P-50 | Vinyl acetate/vinyl propionate copolymer (75:25) |
| P-51 | Butyl methacrylate/sodium 3-acryloxybutane-1-sulfonate copolymer (97:3) |
| P-52 | Butyl methacrylate/methyl methacrylate/acrylamide copolymer (35:35:30) |
| P-53 | Butyl methacrylate/methyl methacrylate/vinyl chloride copolymer (37:36:27) |
| P-54 | Butyl methacrylate/styrene copolymer (82:12) |
| P-55 | t-Butyl methacrylate/methyl methacrylate copolymer (70:30) |
| P-56 | Poly(N-t-butylmethacrylamide) |
| P-57 | N-t-butylacrylamide/methylphenyl methacrylamide copolymer (60:40) |
| P-58 | Methyl methacrylate/acrylonitril copolymer (70:30) |
| P-59 | Methyl methacrylate/methyl vinyl ketone copolymer (38:72) |
| P-60 | Methyl methacrylate/styrene copolymer (75:25) |
| P-61 | Methyl methacrylate/hexyl methacrylate copolymer (70:30) |
| P-62 | Butyl methacrylate/acrylic acid copolymer (85:15) |
| P-63 | Methyl methacrylate/acrylic acid copolymer (80:20) |
| P-64 | Methyl methacrylate/acrylic acid copolymer (90:10) |
| P-65 | Methyl methacrylate/acrylic acid copolymer (98:2) |
| P-66 | Methyl methacrylate/N-vinyl-2-pyrrolidone copolymer (90:10) |
| P-67 | Butyl methacrylate/vinyl chloride copolymer (90:10) |
| P-68 | Butyl methacrylate/styrene copolymer (70:30) |
| P-69 | 1,4-butanediol/adipic acid polyester |
| P-70 | Ethylene glycol/sebacic acid polyester |
| P-71 | Polycaprolactam |
| P-72 | Polypropiolactam |
| P-73 | Polydimethylpropiolactone |
| P-74 | N-t-butylacrylamide/dimethylaminoethylacrylamide copolymer (85:15) |
| P-75 | N-t-butylmethacrylamide/vinylpyridine copolymer (95:5) |
| P-76 | Diethyl maleate/butyl acrylate copolymer (65:35) |
| P-77 | N-t-butylacrylamide/2-methoxyethyl acrylate copolymer (55:45) |
| P-78 | ω-Methoxypolyethylene glycol methacrylate (adding moles n = 6)/methyl methacrylate copolymer (40:60) |
| P-79 | ω-Methoxypolyethylene glycol acrylate (adding moles n = 9)/N-t-butylacrylamide (25:75) |
| P-80 | Poly(2-methoxyethyl acrylate) |
| P-81 | Poly(2-methoxyethyl methacrylate) |
| P-82 | Poly[2-(methoxyethoxy)ethyl acrylate] |
| P-83 | 2-(2-butoxyethoxy)ethyl acrylate/methyl methacrylate copolymer (58:42) |
| P-84 | Poly(oxycarbonyloxy-1,4-phenyleneisobutylidene-1,4-phenylene) |
| P-85 | Poly(oxyethyleneoxycarbonyliminohexamethyleneimino-carbonyl) |
| P-86 | N-[4-(4'-hydroxyphenylsulfonyl)phenyl]acrylamide/butyl acrylate copolymer (65:35) |
| P-87 | N-(4-hydroxyphenyl)methacrylamide/N-t-butylacrylamide copolymer (50:50) |
| P-88 | [4-(4'-hydroxyphenylsulfonyl)phenoxymethyl]styrene (mixture of m- and p-compound)/N-t-butylacrylamide copolymer (15:85) |

The organic solvent-soluble polymer may be added to the yellow dye image forming silver halide emulsion layer in a form of a dispersion or an aqueous latex. The dispersion of the polymer may be prepared by dissolving the polymer in a high-boiling solvent having a boiling point of 150° C. or more, preferably together with the coupler and another additives, and dispersing the solution in a hydrophilic binder such as an aqueous gelatin solution with a surfactant. A low-boiling solvent may be used together with the high-boiling solvent according to necessity.

In the light-sensitive material of the invention, a polymer containing a structural unit represented by Formula II is added to a light-sensitive layer or a light-insensitive layer to improve the color forming efficiency, the whiteness of background and the storage ability of the raw light-sensitive material.

Formula II

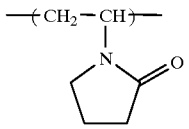

Polyvinylpyrrolidone, a copolymer of N-vinylpyrrolidone and 2-(N-acyl)aminoethyl acrylate, and a copolymer of N-vinylpyrrolidone and 2-(N-acyl)aminoethyl methacrylate, such as those described in Japanese Patent Publication 48-3841 are preferred as the polymer having the unit represented by Formula II. Among them polyvinylpyrrolidone is particularly preferable. The compound having the unit represented by Formula II preferably has an average molecular weight Mw of from 1,000 to 1,000,000, more preferably from 10,000 to 100,000. The amount of the coating amount of the polymer having a constituting unit represented by Formula II is preferably from 1.0 mg to 200 mg, more preferably from 5.0 mg to 100 mg, per square meter.

The foregoing light-sensitive material of the invention preferably contains a fluorine-containing surfactant represented by following Formula III or a compound represented by Formula IV. The compound represented by Formula III is described below.

Formula III $$(Cf)—(Y)_n$$

In the formula, Cf represents a n-valent group having three or more fluorine atoms and two or more carbon atoms, Y is a —COOM group, an —$SO_3M$ group, an —$OSO_3M$ group or a —P(=O) $(OM)_2$ group. M is a hydrogen atom or a cation such as an alkali metal atom and a quaternary ammonium salt, and n is an integer of 1 or 2.

Examples of the fluorine-containing surfactant represented by Formula III are shown below.

(III)-1

$C_7F_{15}COONH_4$ (III)-2

$C_{10}F_{21}(CH_2)_{10}COOH$ (III)-3

$C_8F_{17}SO_2—N(C_3H_7)CH_2CH_2O(CH_2)_3SO_3Na$ (III)-4

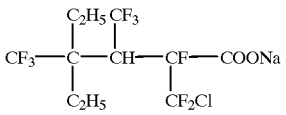

-continued (III)-5

$ClCF_2—(CFCl)CF_2)_4—COOH$ (III)-6

$H(CF_2)_{10}COOH$ (III)-7

$HOOC(CF_2—CF(Cl))_4COOH$ (III)-8

$Cl(CF_2—CF(Cl))_3CF_2COOK$ (III)-9

$C_5F_{11}CH=CH(CH_2)_3COONa$ (III)-10

$C_4F_9—CF(CF_3)(CH_2)_{10}COONa$ (III)-11

$C_4F_9CO—N(CH_3)CH_2CH_2COOH$ (III)-12

$Cl(CF_2)_6COONa$ (III)-13

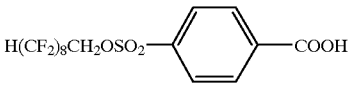

(III)-14

$C_{10}F_{21}CH_2CH_2SO_2—N(C_2H_5)CH_2COONa$ (III)-15

$C_6F_{13}CO—N(C_2H_5)CH_2COONa$ (III)-16

$C_8F_{17}SO_2—N(C_3H_7)CH_2CH_2SO_3Na$ (III)-17

$C_8F_{17}CO—N(C_2H_5)CH_2CH_2SO_3Na$ (III)-18

$C_8F_{17}SO_2—N(C_2H_5)CH_2COONa$ (III)-19

$C_8F_{17}SO_2—N(C_3H_7)CH_2COOK$ (III)-20

$C_8F_{17}SO_2—N(CH_3)(CH_2CH_2O)_4(CH_2)_4SO_3Na$ (III)-21

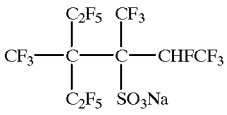

-continued (III)-22

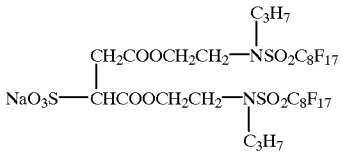

(III)-23

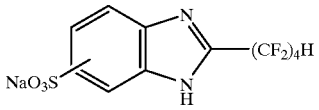

Compound having the —$SO_3Na$ at 4-or 5-position, or a mixture thereof (III)-24

$H(CF_2)_6CH_2PO_3H_2$ (III)-25

$H(CF_2)_8PO_3Na_2$ (III)-26

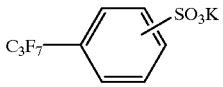

Compound having the —$SO_3K$ at o-, -m or p-position, or a mixture thereof (III)-27

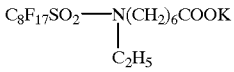

(III)-28

$C_{12}F_{25}CH_2OSO_3Na$ (III)-29

$C_7F_{15}COO(CH_2)_3SO_3K$ (III)-30

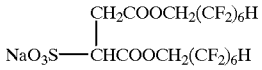

(III)-31

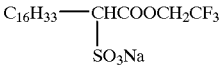

(III)-32

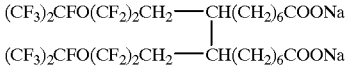

(III)-33

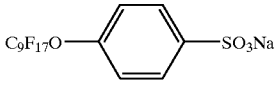

(III)-34

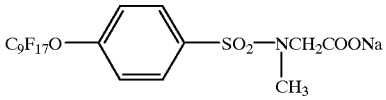

(III)-35

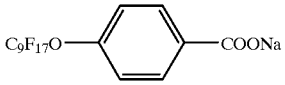

(III)-36

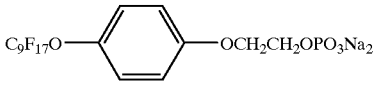

-continued (III)-37

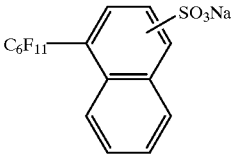

(III)-38

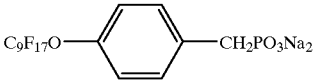

(III)-39

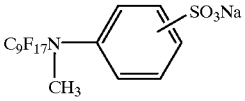

(III)-41

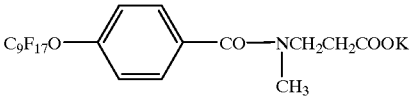

(III)-42

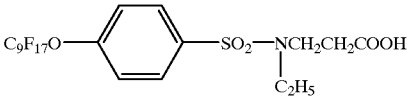

(III)-43

$C_9F_{17}OCH_2CH_2OSO_3Na$ (III)-44

$C_9F_{17}O(CH_2)_4OPO_3Na_2$ (III)-45

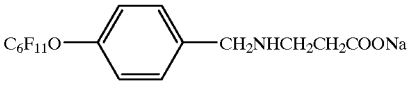

(III)-46

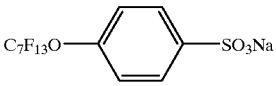

(III)-47

$H(CF_2)_7O(CH_2)_3SO_3Na$ (III)-48

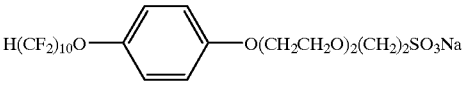

(III)-49

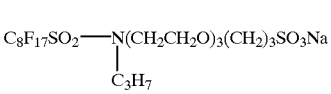

(III)-50

$C_8F_{17}SO_3Na$

The amount of the fluorine-containing surfactant to be added to the light-sensitive material is preferably from 0.05 mg to 1,000 mg, more preferably from 0.1 mg to 500 mg, further preferably from 0.5 mg to 200 mg, per square meter.

The compound represented by Formula IV is described below.

Formula IV

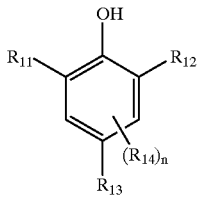

In Formula IV, $R_{11}$, $R_{12}$, and $R_{13}$ are each a hydrogen atom or an unsubstituted alkyl group which may be a straight- or branched-chain alkyl group, $R_{14}$ is an alkyl group which may be a straight- or branched-chain alkyl group, or a halogen atom, provided that at least one of $R_{11}$, $R_{12}$, and $R_{13}$ is the alkyl group, n is 0, 1 or 2, and two $R_{14}$s may be the same or different when n is 2.

Examples of the straight- or branched-chain alkyl group represented by $R_{11}$, $R_{12}$, or $R_{13}$ include a methyl group, an ethyl group, a propyl group, an iso-propyl group, a butyl group, a sec-butyl group, a tert-butyl group, a pentyl group, a tert-pentyl group, a hexyl group, an octyl group, a tert-octyl group, a nonyl group, a decyl group, a dodecyl group, a tert-dodecyl group, a sec-tetradecyl group, an iso-palmityl group, a stearyl group and an iso-stearyl group.

Although the alkyl group represented by $R_{14}$ is similar to that represented by $R_{11}$, $R_{12}$ or $R_{13}$, the alkyl group may have a substituent. As the halogen atom represented by $R_{14}$, a fluorine atom, a chlorine atom, a bromine atom and an iodine atom are cited.

It is preferable that n is 0 and that one of $R_{11}$ and $R_{12}$ is a hydrogen atom. It is more preferable that n is 0, $R_{11}$ and $R_{12}$ are each a hydrogen atom and $R_{13}$ is a branched-chain alkyl group, in other words a phenol compound having a branched-chain alkyl group only at the p-position as the substituent. It is further preferable that n is 0, $R_{11}$ and $R_{12}$ are each hydrogen atom and $R_{13}$ is a branched-alkyl group having from 8 to 12 carbon atoms. It is most preferable that n is 0, $R_{11}$ and $R_{12}$ are each hydrogen atom and $R_{13}$ is a branched-alkyl group having from 9 to 12 carbon atoms.

Examples of the compound represented by Formula IV are shown below.

(IV-1)

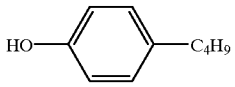

(IV-2)

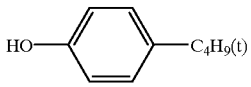

(IV-3)

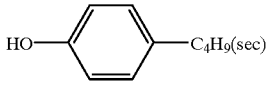

-continued (IV-4)

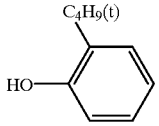

(IV-5)

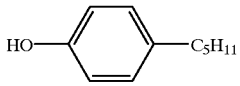

(IV-6)

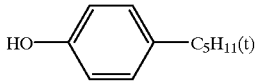

(IV-7)

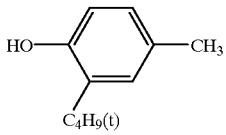

(IV-8)

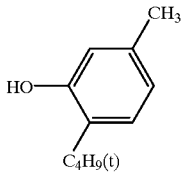

(IV-9)

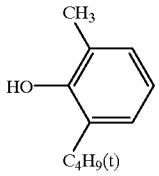

(IV-10)

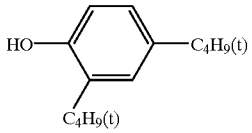

(IV-11)

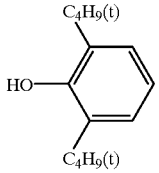

(IV-12)

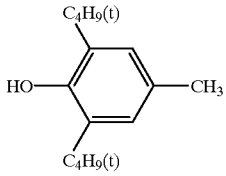

-continued (IV-13)

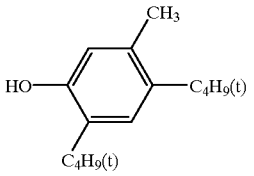

(IV-14)

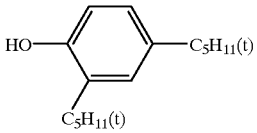

(IV-15)

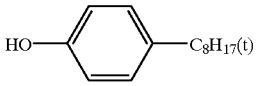

(IV-16)

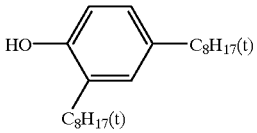

(IV-17)

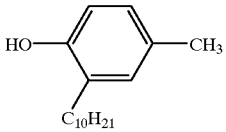

(IV-18)

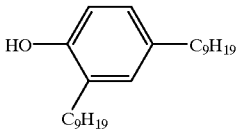

(IV-19)

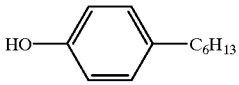

(IV-20)

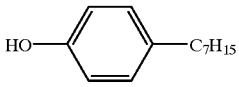

(IV-21)

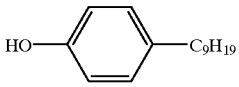

(IV-22)

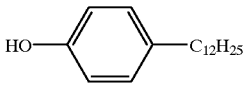

(IV-23)

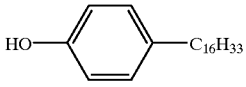

-continued (IV-24)

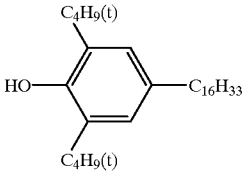

The compound represented by Formula IV is preferably used in an amount of from $1\times10^{-2}$ moles to 5 moles, more preferably from $5\times10^{-2}$ moles to 2 moles, per mole of the yellow dye-forming coupler represented by Formula I.

The compound represented by Formula IV is added to the yellow dye image forming emulsion layer in a form of dispersion in an aqueous gelatin solution by the use of a surfactant represented by Formula V. The dispersion of the compound may be prepared by dissolving the compound in a high-boiling organic solvent singly or together with the yellow dye forming coupler and dispersing in an aqueous gelatin solution.

The surfactant represented by Formula V is described below.

Formula V $$(C_1)—(Y)_n$$

In Formula V, $C_1$ is a n-valent group having at least 2 carbon atoms, and Y is —COOM, —$SO_3$M, —$OSO_3$M or —P(=O) $(OM)_2$. M is a hydrogen atom, an alkali metal atom or a cation such as a quaternary ammonium salt, and n is 1 or 2.

As the surfactant represented by Formula V, Compounds A-1 to A-11 described in Japanese Patent Publication Open to Public Inspection (JP O.P.I.) No. 64-26854 are cited. An anion surfactant such as a benzenesulfonic acid derivative, a naphthalenesulfonic acid derivative and a sulfosuccinic acid derivative, is preferred. An anion surfactant of sulfosuccinic acid derivative is particularly preferable.

Furthermore, it is preferred to add a compound represented by Formula VI into the yellow dye image-forming emulsion layer of light-sensitive material of the invention for improving the color forming efficiency, background whiteness and storage ability of image.

Formula VI

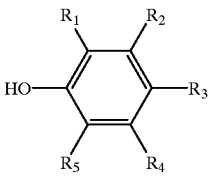

In Formula VI, $R_1$ is a tertiary alkyl group such as a t-butyl group, a t-pentyl group and a t-octyl group, preferably a t-butyl group. $R_2$ is a primary or secondary alkyl group such as a methyl group, an ethyl group and an iso-propyl group, preferably a methyl group, the alkyl group may be substituted with a substituent other than a phenyl group. $R_3$, $R_4$ and $R_5$ are each an alkyl group such as a methyl group, an ethyl group, a butyl group and a dodecyl group, an alkoxycarbonyl group such as an ethoxycarbonyl group, a phenoxycarbonyl group such as 2,4-di-t-butylphenoxycarbonyl group, an alkoxy group such as a 2-ethylhexyloxy group, a phenoxy group such as a 4-(2-ethylhexyl)phenoxy group and a 4-dodecylphenoxy group, and a phenylthio group such as a 3-t-butylphenylthio group, a 4-hydroxyphenylthio group and a 5-methylphenylthio group.

The group represented by $R_1$, $R_2$, $R_3$ or $R_4$ may have a substituent, and the group represented by $R_4$ is preferably an alkyl group The compound represented by Formula VI may be used together with another discoloration preventing agent.

Examples of the compound represented by Formula VI are shown below.

VI-1

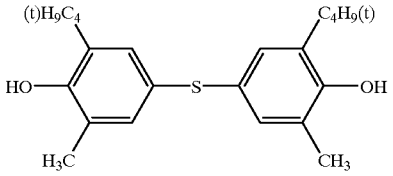

VI-2

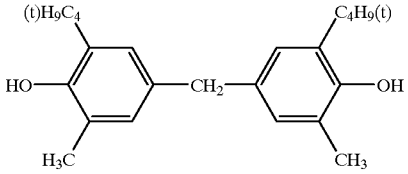

VI-3

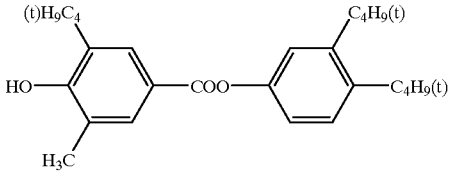

VI-4

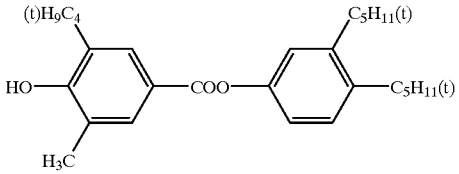

-continued

VI-5

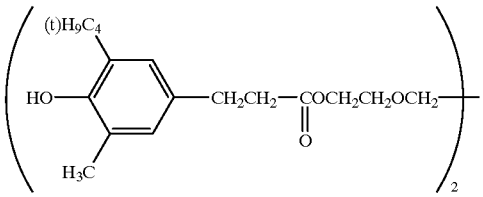

VI-6

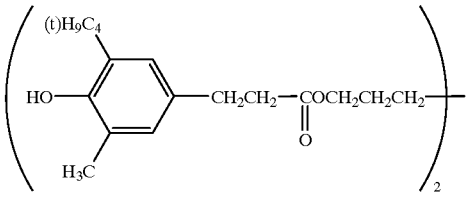

VI-7

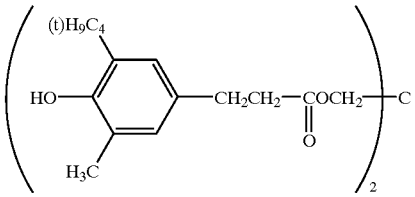

VI-8

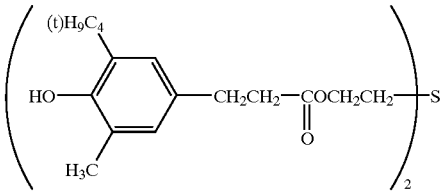

VI-9

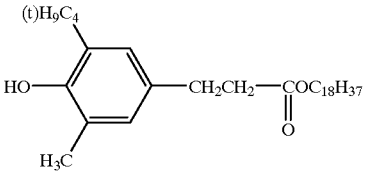

VI-10

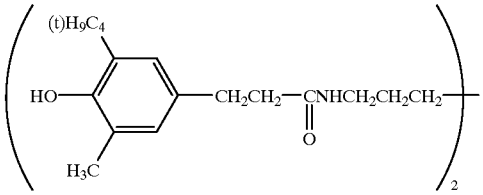

-continued
VI-11
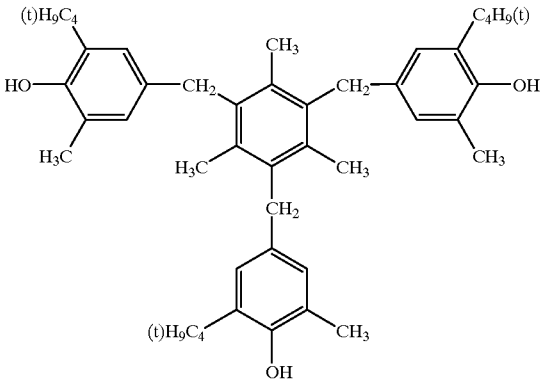
VI-12
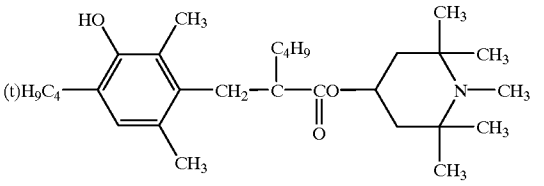
VI-13
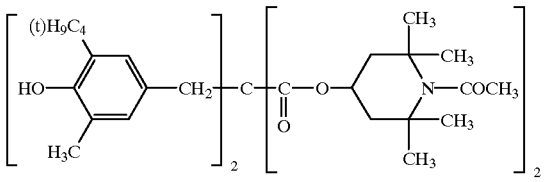
VI-14
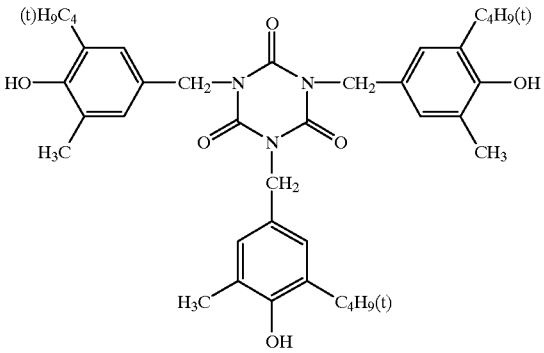
-continued
VI-15
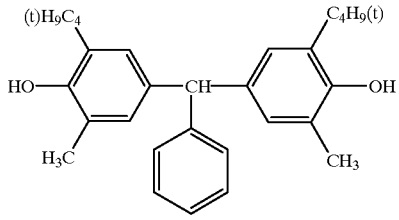
VI-16
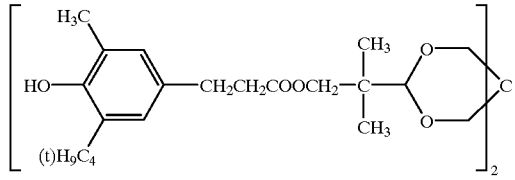
VI-17
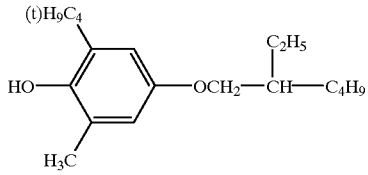
VI-18
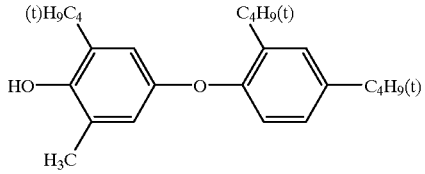
Among the compounds represented by Formula VI, compounds represented by Formula (VI-a) or (VI-b) are preferable, each of which has an ester group and an oxidation potential of not more than 1800 mV.
Formula VI-a
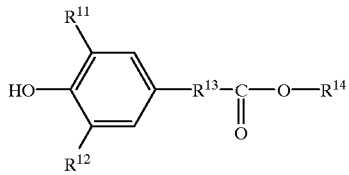

Formula VI-b

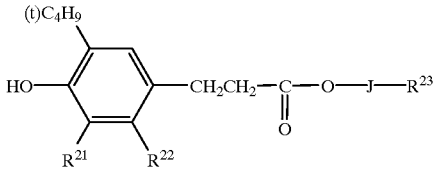

In Formula VI-a, $R^{11}$ and $R^{12}$ are each an alkyl group. As the alkyl group represented by $R^{11}$ or $R^{12}$, a straight- or branched-chain alkyl group having from 1 to 24 carbon atoms, such as a methyl group, an ethyl group, an i-propyl group, a t-butyl group, an octyl group, a 2-ethylhexyl group, a dodecyl group, a tetradecyl group, an eicosyl group, and a benzyl group, is preferable. Among them, the branched alkyl group is particularly preferred.

$R^{13}$ is a divalent bonding group. As the bonding group represented by $R^{13}$, an alkylene group and a phenylene group are preferable which may have a substituent, and a straight-chain alkylene group is particularly preferable. The number of carbon atoms contained in the group represented by $R^{13}$ is preferably from 1 to 10, more preferably from 2 to 6.

$R^{14}$ is a hydrogen atom or a substituent. Preferable substituent represented by $R^{14}$ is an alkyl group, a cycloalkyl group, an alkenyl group, an aryl group, an alkylamino group, an alkylthio group, an arylthio group, an alkoxycarbonyl group, and an aryloxycarbonyl group. It is preferred that the group represented by $R^{14}$ has at least one branching off point in the structure thereof.

Examples of the alkyl group represented by $R^{14}$ include a methyl group, an ethyl group, a propyl group, a butyl group, and an amyl group. As the alkylene group represented by J, an alkylene group having 1 to 20 carbon atoms such as a methylene group, an ethylene group, a propylene group, and a butylene group are cited. These alkylene groups each may have a branch. As the heterocyclic residue represented by $R^{23}$, a 5- and 6-member heterocyclic residue containing a hetero atoms such as an oxygen atom, a sulfur atom or a nitrogen atom, for example, a thienyl group, a furyl group, a pyrrolyl group, a pyrrolydinyl group, a piperydinyl group, a piperadinyl group, a morphorinyl group, a thia-cyclohexyl group, a dithiacyclohexyl group, an oxacyclohexyl, is cited. These heterocyclic residues each may be condensed with another heterocyclic ring or a hydrocarbon ring, and may be form a spiro compound.

The oxidation potential of the compound represented by Formula VI-a or VI-b is preferably within the range of from 800 mV to 1800 mV, particularly from 1200 mV to 1600 mV. A preferred compound is one represented by Formula VI, in which $R^{21}$ is a methyl group and $R^{22}$ is a hydrogen atom.

Examples of the compound represented by Formula VI-a or VI-b are shown below.

VI-a-1

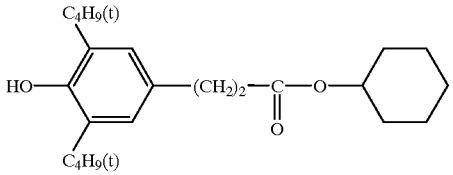

VI-a-2

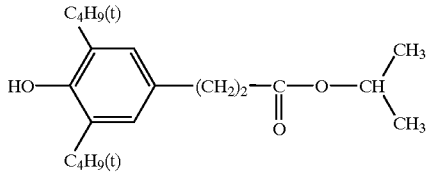

VI-a-3

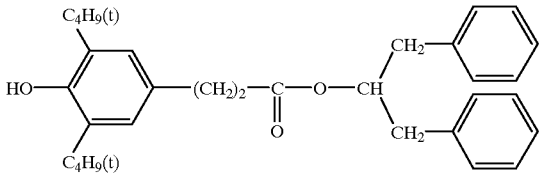

VI-a-4

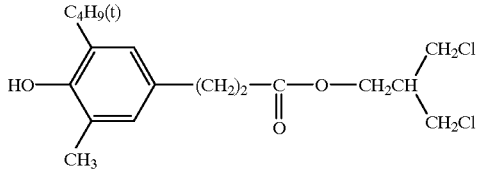

VI-a-5

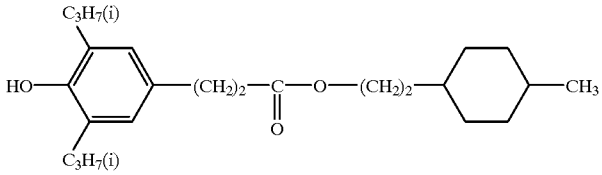

VI-a-6

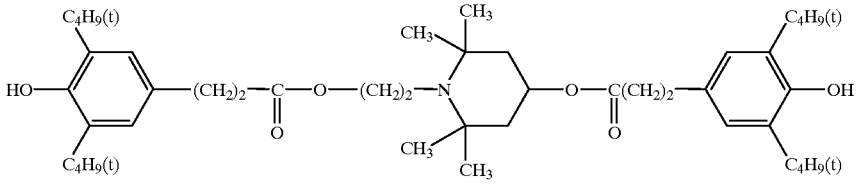

-continued
VI-a-7
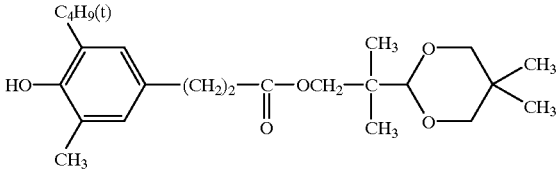
VI-a-8
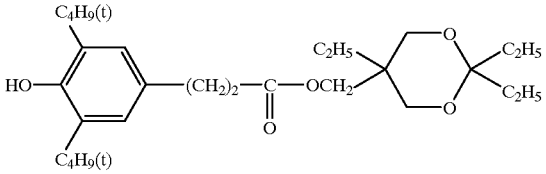
VI-a-9
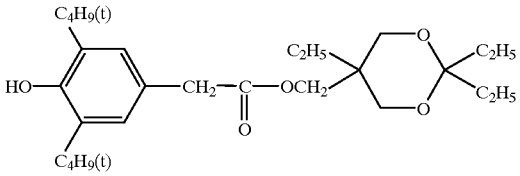
VI-a-10
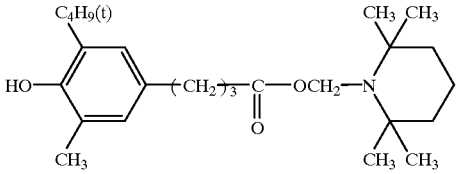
VI-a-11
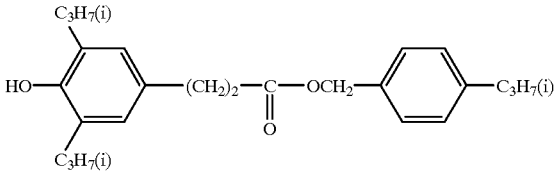
VI-a-12
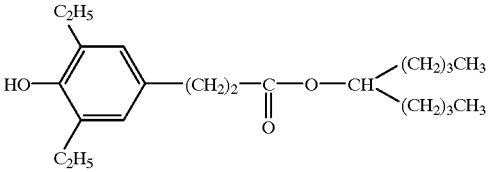
VI-a-13
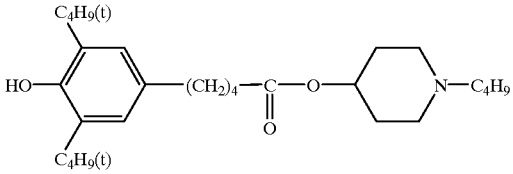
VI-a-14
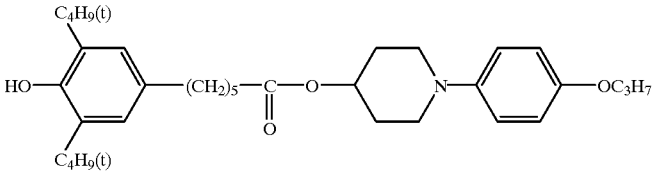
VI-a-15
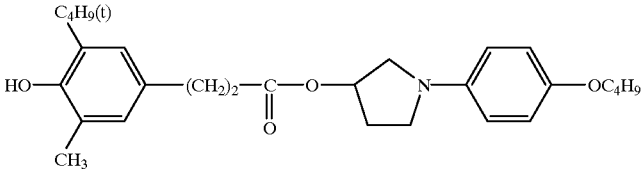
VI-a-16
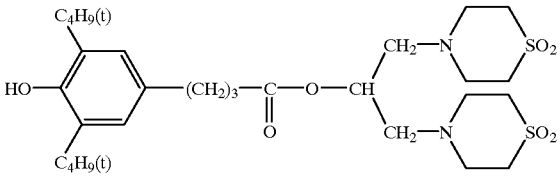
VI-a-17
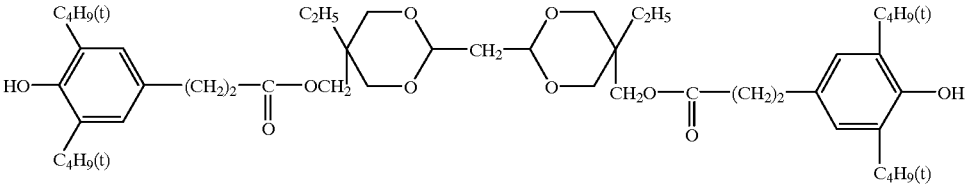

-continued
VI-a-18
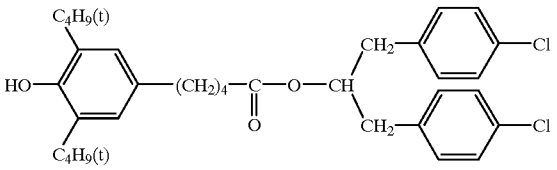
VI-a-19
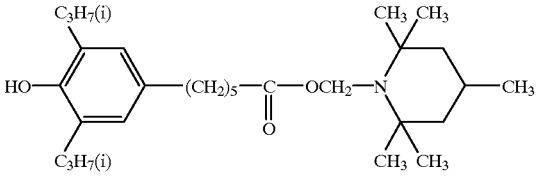
VI-a-20
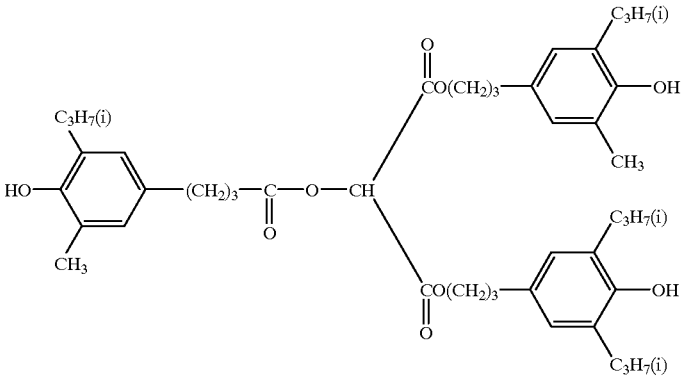
VI-a-21
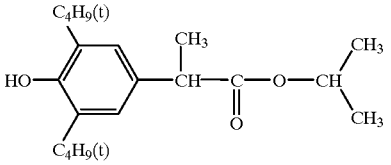
VI-a-22
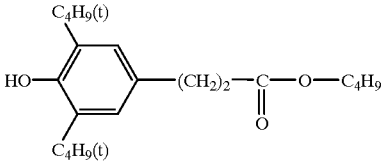
VI-a-23
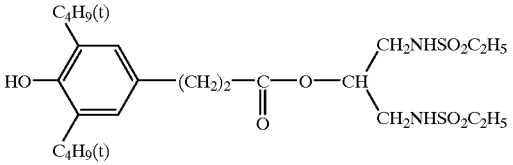
VI-a-24
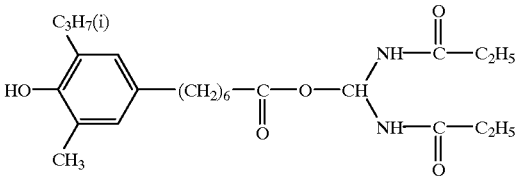
VI-a-25
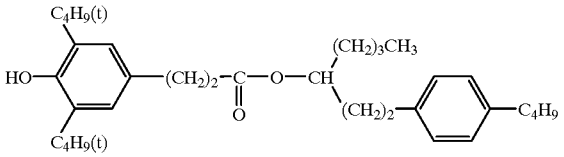
VI-b-1
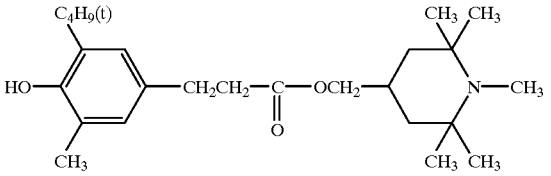
VI-b-2
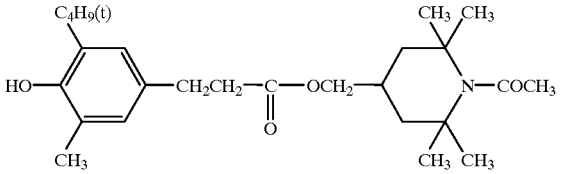
VI-b-3
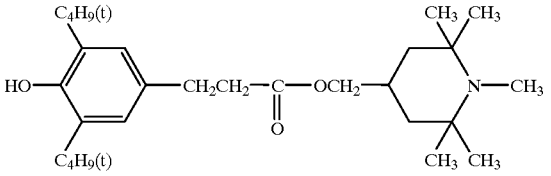
VI-b-4
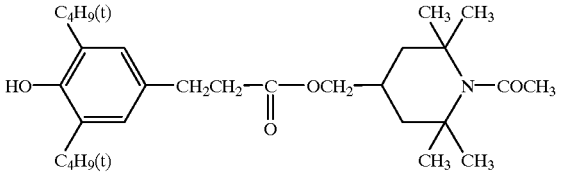

-continued
VI-b-5
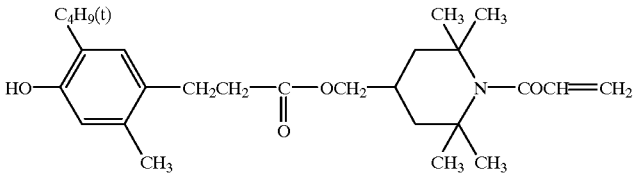
VI-b-6
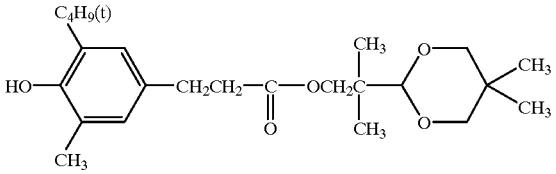
VI-b-7
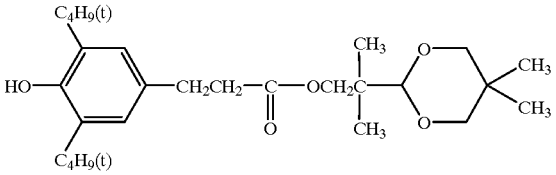
VI-b-8
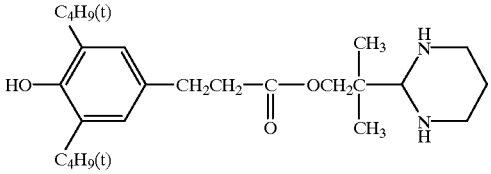
VI-b-9
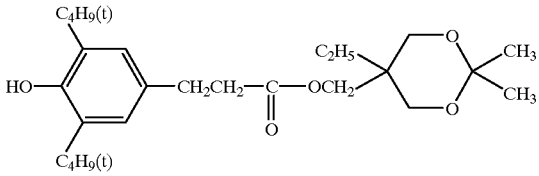
VI-b-10
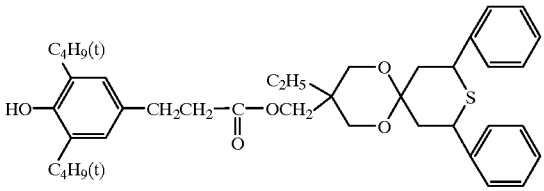
VI-b-11
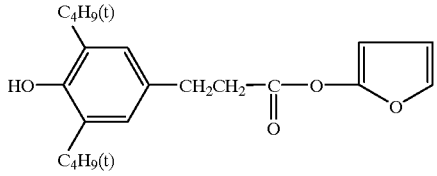
VI-b-12
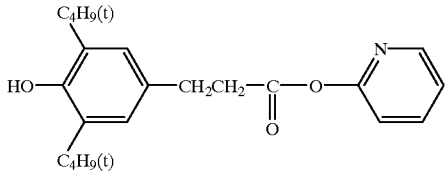
VI-b-13
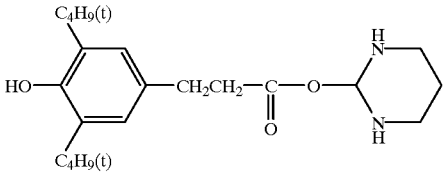
VI-b-14
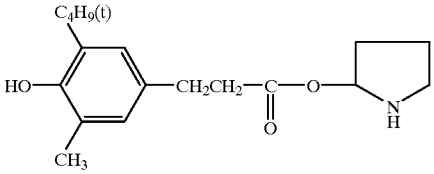
VI-b-15
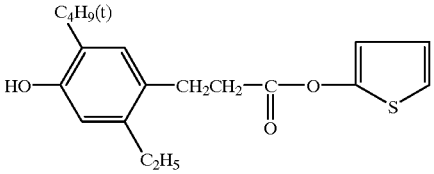
VI-b-16
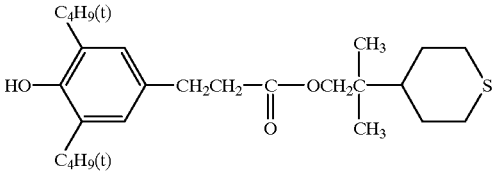
VI-b-17
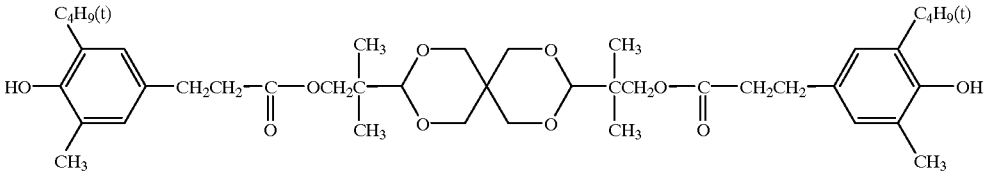

-continued

VI-b-18

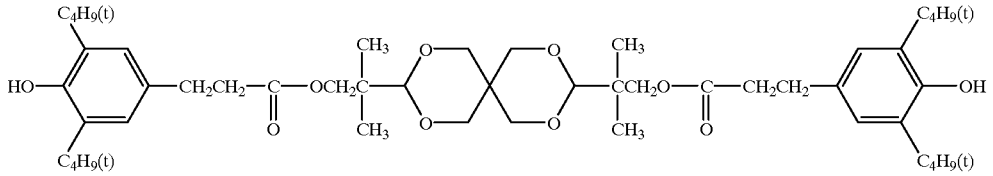

VI-b-19

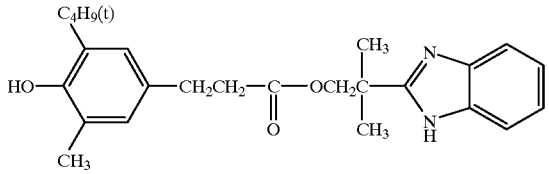

VI-b-20

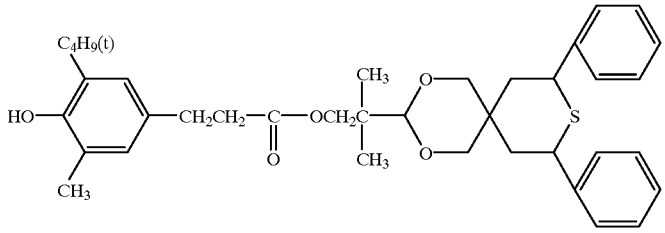

These compounds can be easily synthesized by the method described in European Patent No. 310,552.

Among the compounds represented by Formula VI, Compound V-b-17 is particularly preferred.

The amount of the compound of Formula VI is preferably from $0.03\times10^{-3}$ moles to $0.5\times10^{-3}$ moles, more preferably from $0.05\times10^{-3}$ moles to $0.3\times10^{-3}$ moles, per square meter.

Although the silver halide emulsion relating to the invention may optionally have any composition such as silver chloride, silver bromide, silver chlorobromide, silver iodobromide, silver chloroiodobromide and chloroiodide, silver chlorobromide having a silver chloride content of not less than 95 mole-% and substantially no silver iodide is preferred. A silver halide emulsion having a silver chloride content of not less than 97 mole-%, particularly from 98 to 99.9 mole-%, is preferable from the viewpoint of rapidness of processing and processing stability.

A silver halide emulsion is preferably used in the invention, which is comprised of silver halide grains each locally having a portion containing silver bromide in a high concentration. In such the case, the silver halide grain may be a grain on which the portion of high silver bromide concentration is epitaxially contacted, a core-shell type grain or a grain in which the area having different composition is locally existed without formation of a complete layer. The composition of silver halide may be varied continuously or discontinuously. It is particularly preferred that the portion with a high concentration of silver bromide is existed on a corner of the silver halide grain crystal.

It is advantageous to contain a heavy metal ion in the silver halide grain. The heavy metal ion usable for such the purpose includes that of a metal of Groups 8 to 10 of the periodic table such as iron, iridium, platinum, palladium, nickel, rhodium, osmium, ruthenium and cobalt, a transition metal of Group 12 of the periodic table such as cadmium, zinc and mercury, and lead, rhenium, molybdenum, tungsten, gallium and chromium. Among them, ions of iron, iridium, platinum, ruthenium, gallium and osmium are preferred.

These metal ions may be added in a form of salt or a complex salt to the silver halide emulsion.

When the heavy metal ion is used in the form of complex salt, a cyanide ion, a thiocyanate ion, an isothiocyanate ion, a cyanate ion, a chloride ion, a bromide ion, an iodide ion, a nitrate ion, a carbonyl and ammonia are usable as the ligand or ion to form the complex salt. Among them, the cyanide ion, thiocyanate ion, isothiocyanate ion, chloride ion and bromide ion are preferable.

To contain the heavy metal ion in the silver halide emulsion, the heavy metal compound is added at an optional step in the course of preparation of the emulsion such as before formation of silver halide grains, during the process of silver halide grain formation, and the physical ripening after the silver halide grain formation. The heavy metal compound may be dissolved in together with a halide salt to be added continuously added in the full or a part of the course of silver halide grain formation.

The amount of the heavy metal compound to be added to the silver halide emulsion is preferably from $1\times10^{-9}$ moles to $1\times10^{-2}$ moles, particularly from $1\times10^{-8}$ moles to $5\times10^{-5}$ moles, per mole of silver halide.

In the light-sensitive material of the invention, silver halide grains having any shape may be optionally used. One of preferable examples is a cubic grain having (100) face as the crystal surface thereof. Moreover, an octahedral grain, tetradecahedral grain or a dodecahedral grain may be used, which can be prepared according to a method described in U.S. Pat. Nos. 4,183,756 and 4,225,666, JP O.P.I. No. 55-25689, JP 55-42737 and J. Photogr. Sci. 21. 39, 1973. A grain having a twined face is also usable.

In the invention, silver halide grains each having the unified shape are preferably used, and it is particularly preferred that two or more kinds of monodisperse silver halide emulsion are added to one silver halide emulsion layer.

Although there is no limitation in the invention on the grain size of the silver halide emulsion, a size of from 0.1 μm to 1.2 μm, particularly from 0.2 μm to 1.0 μm, is preferable from the viewpoint of another photographic property.

The grain size can be measured by the projection area or the approximate diameter of the grain. When the shapes of the grains are substantially the same, the distribution of grain size can be almost exactly defined based on the diameter or the projection area thereof.

The size distribution of silver halide grains is preferably not more than 0.22, more preferably not more than 0.15, in the variation coefficient thereof. It is particularly preferable that two or more kinds of monodisperse emulsion each having a variation coefficient of not more than 0.15 are added in the same emulsion layer. The variation coefficient is a coefficient representing the broadness of the grain size distribution, and is defined by the following equation.

Variation coefficient=S/R

In the above equation, S is the standard deviation of grain size distribution and R is the average size distribution. Here, the grain size is the diameter of the grain when the silver halide grain is spherical. When the shape of the grain is a shape other than spherical and cubic, the size is defined by the diameter of circle corresponding to the projection area of the grain.

The silver halide emulsion may be prepared by various apparatus and methods known in the field of the art.

The silver halide grain may he prepared by any of an acid method, a neutral method an ammoniacal method. The silver halide grain may be one grown on one step or one formed by growing a previously prepared seed grain. The method for preparing the seed grain and the for growing the seed grain may be the same or different from each other.

Although the method to react a soluble silver salt with a soluble halide salt may be any of an ordinary mixing method, a reversal mixing method, a double-jet mixing method and a combination thereof, an emulsion prepared by the double-jet method is preferable. A pAg controlled double-jet method such as that described in JP O.P.I. No. 54-48521 can also be usable.

An apparatus described in JP O.P.I. Nos. 57-92523 and 57-92524 in which the silver salt solution and the halide salt solution are supplied through a adding device installed in the reaction mother liquid, an apparatus described in German Patent OSL No. 2921164 in which the concentration of the soluble silver salt solution and that of the soluble halide salt solution are continuously varied in the course of addition, and an apparatus described in JP No. 56-501776 in which the formation of grain is performed while maintaining the distance between the silver halide grains at constant by taking out the reaction mother liquid from the reaction vessel for concentrating the mother liquid by an ultra-filtration, may also be applied.

A silver halide solvent such as a thioether may be used if it is necessary. A compound, for example, a compound having a mercapto group, a nitrogen-containing heterocyclic compound and a sensitizing dye, may be added in the period of grain formation or after grain formation.

A sensitization using a gold compound and that using a chalcogen sensitizer may be applied in combination to the silver halide emulsion.

As the chalcogen sensitizer, a sulfur sensitizer, a selenium sensitizer and a tellurium sensitizer may be used, and the sulfur sensitizer is preferred. Examples of the sulfur sensitizer include a thiosulfate, allythiocarbamidethiourea, allylthiocyanate, cystine, a p-toluenethiosulfonate, rhodanine and elemental sulfur.

The adding amount of the sulfur sensitizer is preferably from $5\times10^{-10}$ moles to $5\times10^{-5}$ moles, more preferably from $5\times10^{-8}$ moles to $3\times10^{-5}$ moles, pre mole of silver halide even though the amount may be changed according to the kind of the silver halide emulsion and the expected effect of the sensitizer.

The gold sensitizer may be added in a form of chloroauric acid, gold sulfide, or a gold complex salt. As the ligand compound of the gold complex salt, dimethylrhodanine, a thiocyanate, a mercaptotetrazole and a mercaptotriazole are preferable. The using amount of the gold compound is usually from $1\times10^{-8}$ moles to $1\times10^{-4}$ moles, preferably from $1\times10^{-8}$ moles to $1\times10^{-5}$ moles, per mole of silver halide, even though the amount may be varied according to the kind of silver halide emulsion, the kind of compound and the condition of ripening.

A reducing sensitization may be applied to sensitize the emulsion.

In the emulsion, a well known anti-fogging agent or a stabilizing agent may be added to the emulsion for protecting the light-sensitive material from fogging during the producing process, variation of properties during storage and fogging during the processing. Examples of the agent preferably usable for such the purpose include compounds represented by Formula (II) described in JP O.P.I. No. 2-146036, page 7, lower column, and concrete examples of preferable compound include Compounds (IIa-1) to (IIa-8) and (IIb-1) to (IIb-7) described in the same publication, page 8, and 1-(3-methoxyphenyl)-5-mercaptotetrazole and 1-(4-ethoxyphenyl)-5-mercaptotetrazole. These compounds may be added to the emulsion at any of the steps of grain formation, chemical sensitization, after completion of chemical sensitization and preparation of coating liquid, according to the purpose of the addition. The compound is preferably used in an amount of from $1\times10^{-5}$ moles to $5\times10^{-4}$ moles per mole of silver halide when the chemical sensitization is performed in the presence the compound. When the compound is added at the completion of chemical sensitization, the amount of the compound is preferably from $1\times10^{-6}$ moles to $1\times10^{-2}$ moles, more preferably from $1\times10^{-5}$ moles to $5\times10^{-3}$ moles per mole of silver halide. When the compound is added at the step of coating liquid preparation, the amount of the compound is preferably from $1\times10^{-6}$ moles to $1\times10^{-1}$ moles, more preferably from $1\times10^{-5}$ moles to $1\times10^{-2}$ moles, per mole of silver halide. When the compound is added to a layer other than the silver halide emulsion layer, the amount of the compound in the layer is preferably from $1\times10^{-9}$ moles to $1\times10^{-3}$ moles per square meter.

In the light-sensitive material of the invention, a dye absorbing various wavelength of light may be added for various purposes such as anti-irradiation and anti-halation.

To such the purpose, various known compounds may be used, particularly, Dyes AI-1 to AI-11 described in JP O.P.I. No. 3-251840, page 308, and the dyes described in JP O.P.I. No. 6-3770 are preferably usable as a dye absorbing visible rays. As an infrared absorbing dye, compounds represented by Formulas (I), (II) and (III) described in JP O.P.I. No. 1-280750, page 2, lower left column, are preferable, since the compounds does not influence to photographic properties of the silver halide emulsion and does not cause stain by remaining color. Concrete examples of the compound are Exemplified Compounds (1) to (45) described on page 3, left lower column through page 5, left lower column of the same publication.

For improving the image sharpness, the dye is preferably used in an amount necessary to make the spectral reflection density at 680 nm of the light-sensitive material before processing to 0.7 or more, more preferably 0.8 or more.

It is preferable to add a fluorescent whitening agent to the light-sensitive material for.raising the whiteness of the background. Examples of the compound are those represented by Formula II described in JP O.P.I. No. 2-232652.

When the light-sensitive material of the invention is applied as a color light-sensitive material, the color light-sensitive material has silver halide emulsion layers each composed of silver halide emulsion spectrally sensitized at a specified spectral region within the range of from 400 nm to 900 nm, which are combined with a yellow, magenta and cyan coupler, respectively. The emulsion layer each contains one or more kinds of spectral sensitizing dye.

Known sensitizing dyes may be used for sensitizing the silver halide emulsion to be used in the photographic material of the invention. Sensitizing dyes BS-1 to BS-8 described in JP O.P.I. No. 3-251840, page 28, are preferably used singly or in combination as a blue-sensitizing dye. Sensitizing dye GS-1 to GS-5 described in the same publication, page 18, are preferably used as a green-sensitizing dye. Sensitizing dye RS-1 to RS-8 described in the same publication, page 19, are preferably used as a red-sensitizing dye. Moreover, an infrared sensitizing dye is necessary when the light-sensitive material is imagewise exposed by infrared lays using a semiconductor laser. Sensitizing dye IRS-1 to IRS-11 described in JP O.P.I. No. 4-285950, pages 6 to 8, are preferably used as the infrared-sensitizing dye. It is preferable used Supersensitizing agents SS-1 to SS-9 described in JP O.P.I. No. 285950, pages 8 to 9, or Compounds S-2 to S-17 described in JP O.P.I. No. 5-66515, pages 15 to 17, together with the infrared-, red-, green- or blue-sensitizing dye.

The sensitizing dye may be added to the silver halide emulsion at an optional step from the formation of silver halide grain to the completion of chemical sensitization.

The sensitizing dye may be added in a form of solution in a water-miscible solvent such as methanol, ethanol, fluorized alcohol, acetone and dimethylformamide, or water, or in a form of solid particle dispersion.

A magenta dye forming coupler having a maximum spectral absorption at 500 nm to 600 nm and a cyan dye forming coupler having a maximum spectral absorption at 600 nm to 750 nm are typically used other than the yellow coupler relating to the invention.

The cyan dye forming couplers represented by Formula (C-I) or (C-II) described in JP O.P.I. No. 4-114154, page 5, lower left column, are preferably used in the light-sensitive material according to the invention. Concrete examples of the compound is described as Compounds CC-1 to CC-9 described in the same publication, page 5, upper right column to page 6, lower left column. The magenta dye forming couplers represented by Formula (M-I) or (M-II) described in JP O.P.I. No. 4-114154, page 4, upper right column, are preferably used. Concrete examples of the compound is described as Compounds MC-1 to MC-11 described in the same publication, page, lower left column to page 5, upper right column. Among the foregoing magenta dye forming coupler, a coupler represented by Formula (M-I) is preferable, particularly a coupler in which RM of Formula (M-I) is a tertiary alkyl group is preferred since such the coupler is excellent in the light-fastness. Couplers MC-8 to MC-11 are preferable since they are excellent in the color reproducibility within the range of blue, purple to red, and in the detail reproducibility.

When an oil-in-water type emulsification is applied to addition of the coupler or another organic compound, it is usual that the compound is dissolved in a water-insoluble high-boiling organic solvent, in which a low-boiling solvent and/or a water-soluble organic solvent may be added according to necessity, and dispersed in a hydrophilic binder such as an aqueous solution of gelatin using a surfactant. A stirrer, a homogenizer, a colloid mill, a flowjet mixer and an ultrasonic dispersing device can be used for emulsification of the solution. A process to remove the low-boiling solvent during or after dispersing process may be inserted. As the high-boiling solvent to be used for dispersing the coupler, a phthalic acid ester such as dioctyl phthalate, diisodecyl phthalate and dibutyl phthalate, and a phosphoric acid ester such as tricresyl phosphate and trioctyl phosphate are preferable. The dielectric constant of the high-boiling solvent is preferably from 3.5 to 7.0. Two or more kinds of the high-boiling solvent may be used in combination.

A compound which has a hydrophobic group having 8 to 30 carbon atoms and a sulfonic acid group or its salt in the molecule thereof is preferable as the surfactant for dispersing the photographic additive or controlling the surface tension of the coating liquid. Examples of the surfactant include Compounds A-1 to A-11 described in JP O.P.I. No. 64-26854. A surfactant having an alkyl group substituted with a fluorine atom is also preferably used. The emulsified suspension is usually added to a coating liquid which contains a silver halide emulsion. The period from the preparation of the suspension to the addition of the suspension to the emulsion, and the period of the addition of the suspension to the coating liquid to the coating of the coating liquid are preferred to be shorter, and the period are each preferably not more than 10 hours, more preferably not more than 3 hours, further preferably not more than 20 minutes.

It is preferable to use an discolor preventing agent together with each of the couplers for preventing the discoloration of image dye caused by light, heat or moisture. Phenyl ether compounds represented by Formulas I or II described in JP O.P.I. No. 2-66541, page 3, phenol compounds represented by Formula IIIB described in JP O.P.I. No. 3-174150, amine compounds represented by Formula A described in JP O.P.I. No. 64-90445, metal complex compounds represented by Formulas XII, XIII, XIV or XV described in JP O.P.I. No. 62-182741, are particularly preferable for the magenta dye image. Compounds represented by Formula I' described in JP O.P.I. No. 1-196049 and compounds represented by Formula II described in JP O.P.I. No. 5-11417, are particularly preferable for the yellow image and the cyan dye image.

Compound (d-11) described in JP O.P.I. No. 4-114154, page 9, lower left column, and Compound (A'-1) described in the same publication, page 10, lower left column, are preferably used for shifting the spectral absorption wavelength of the formed dye. Furthermore a fluorescent dye releasing compound described in U.S. Pat. No. 4,774,187 may be used.

It is preferable to add a compound capable of reacting with the oxidation product of a color developing agent into a layer arranged between light-sensitive layers for preventing color contamination, or in to silver halide emulsion layer for preventing fogging. As such the compound, a hydroquinone derivative is preferable, a dialkylhydroquinone such as 2,5-di-t-octylhydroquinone is more preferable. Particularly preferable compound is compounds represented by Formula II described in JP O.P.I. No. 4-133056, for example, Compounds II-1 to II-14 described on pages 13 to 14, and Compound 1 described on page 17 of the same publication.

It is preferable to add an UV-absorbent into the light-sensitive material for preventing the fogging caused by discharge of static electrical charge and raising the light fastness of dye image. A benzotriazole compound is preferable as the UV-absorbent. Particularly preferable compounds are compounds represented by Formula III-3 described in JP O.P.I. No. 1-250944, Compounds UV-1L to UV-27L described in JP O.P.I. No. 63-187240, compounds represented by Formula I described in JP O.P.I. No. 4-1633, and compounds represented by Formula (I) or (II) described in JP O.P.I. No. 5-165144.

Although gelatin is advantageously used as the binder of the light-sensitive material, a hydrophilic colloid substance such as a gelatin derivative, a graftpolymer of gelatin with another polymer, a protein other than gelatin, a sugar derivative, a cellulose derivative and a synthesized homopolymer and copolymer, may also be used according to necessity.

As the hardener for these binders, a vinylsulfon type hardener and a chlorotriazine type hardener are preferable, which may be used singly or in combination. Compounds described in JP O.P.I. Nos. 61-249154 and 61-245153 are preferably used. It is preferable to add a preservative and an antimold agent such as those described in JP O.P.I. No. 3-157646 in to the hydrophilic colloid layer to prevent breeding of a mold and a bacterium. A lubricant and a matting agent described in JP O.P.I. No. 6-118543 are preferably added into a protective layer for improving the surface property of the light-sensitive material before or after processing.

Any material may be used as the support of the light-sensitive material of the invention. For example, paper laminated with polyethylene or polyethylene terephthalate, paper composed of natural or synthesized pulp, a vinyl chloride sheet, a polypropylene or polyethylene terephthalate sheet which may contain a white pigment and baryta paper are usable. Among them, a support composed of paper having a water-proof resin layer on both side thereof is preferable. Polyethylene, polyethylene terephthalate and a copolymer thereof are preferable as the water-proof resin.

An inorganic and/or organic white pigment may be used as the white pigment to be added to the support, and the inorganic pigment is preferable. Examples of the inorganic white pigment include a sulfate of an alkali-earth metal such as barium sulfate, a carbonate of an alkali-earth metal such as calcium carbonate, a silica such as a fine powdered silica and a synthesized silicate, calcium silicate, alumina, hydrous alumina, titanium oxide, zinc oxide, talc and clay. Preferable white pigment is barium sulfate and titanium oxide.

The content of the white pigment in the water-proof resin layer is preferably not less than 13%, more preferably 15%, by weight for improving the image sharpness.

The dispersibility of the white pigment in the water-proof resin layer of the paper support can be measured by the method described in JP O.P.I. No. 2-28640. The dispersibility of the white pigment is preferably not more than 0.20, more preferably not more than 0.15, by the variation coefficient described in the foregoing publication.

It is preferable that the center line average height (SRa) of the support surface is nor more than 0.15 $\mu$m, more preferably not more than 0.12 $\mu$m, since a suitable surface glossiness can be obtained. A little amount of a blue or red tinting agent such a ultramarine and an oil soluble dye is preferably added to the white pigment containing water-proof resin layer of the reflective support or the layer coated on the support to improve the whiteness of the processed light-sensitive material by controlling the balance of the spectral reflection density of the white portion.

The surface of the support may be subjected to a treatment by corona discharge, ultraviolet pays or flame according to necessity. The layer to be coated on the support surface may be coated on the treated surface directly or through a subbing layer. The subbing layer is a layer composed of one or more layers, which is provided for improving various surface properties such as the adhesiveness, anti-static property, dimension stability, abrasion resistivity, hardness, anti-halation property and friction property.

A thickener may be used to improve the coating ability of the coating liquid in the process of the coating of the light-sensitive material. An extrusion coating method and a curtain coating method are advantageous, by which two ore more layers can be simultaneously coated.

To form a photographic image on the light-sensitive material of the invention, an image may be printed on the light-sensitive material by various procedure such as the followings;

- an image recorded on a negative original picture is optically focusing on the light-sensitive material,
- the image is converted to digital information and displayed on a cathode lay tube, and the image displayed on the cathode ray tube is focused on the light-sensitive material, and
- the light-sensitive material is scanned by a laser beam modulated by the digitized information of the image.

The invention is preferably applied to a light-sensitive material containing no developing agent. The invention is preferably applied to a light-sensitive material to be subject to direct visible observation such as a color paper, a reversal color paper, a light-sensitive material for forming a positive image, a light-sensitive material for display and a light-sensitive material for color proof. A light-sensitive material having a reflective support is particularly preferable.

A known aromatic primary amine developing agent may be used for processing the light-sensitive material of the invention. Examples of such the compound are shown below.

CD-1) N,N-diethyl-p-phenylenediamine
CD-2) 2-amino-5-diethylaminotoluene
CD-3) 2-amino-5-(N-ethyl-N-laurylamino)toluene
CD-4) 4-[N-ethyl-N-(β-hydroxyethyl)amino]aniline
CD-5) 2-methyl-4-[N-ethyl-N-(β-hydroxyethyl)amino] aniline
CD-6) 4-amino-3-methyl-N-ethyl-N-[β-(methanesulfonamido)-ethyl]aniline
CD-7) N-(2-amino-5-diethylaminophenylethyl) methanesulfonamide
CD-8) N,N-dimethyl-p-phenylenediamine
CD-9) 4-amino-3-methyl-N-ethyl-N-methoxyethylaniline
CD-10) 4-amino-3-methyl-N-ethyl-N-(β-ethoxyethyl) aniline
CD-11) 4-amino-3-methyl-N-ethyl-N-(γ-hydroxypropyl) aniline Although the developing solution may be used at an optional pH value, the pH value is preferably from 9.5 to 13.0, more preferably from 9.8 to 12.0, from the viewpoint of rapid processing.

The temperature of the color developing is preferably from 35° C. to 70° C. Although a higher temperature is suitable for a shortened processing, a temperature too high is not desirable for stability of the processing. Accordingly, a temperature of from 37° C. to 60° C. is preferable.

The processing is usually performed for about 3 minuets 30 seconds. For the light-sensitive material of the invention, the processing time is preferably not more than 40 seconds, more preferably not more than 25 seconds.

Known components of developing solution may be additionally added to the color developing solution. An alkaline agent having a pH buffering ability, a development inhibitor such as a chloride ion and benzotriazole, a preservant and a chelating agent are commonly used.

The light-sensitive material of the invention is usually subjected to a bleaching treatment and a fixing agent. The bleaching treatment and the fixing treatment may be performed simultaneously. A washing treatment is usually applied after the fixing treatment. A stabilizing treatment may be applied in stead of the washing treatment. For processing the light-sensitive material, a roller transport type processor in which the light-sensitive material is transported by rollers arranged in the processing tank, and an endless belt transport type processor in which the light-sensitive material is fixed on an endless belt to be transported, are usable. A processor having a slit-shaped processing tank in which the light-sensitive material is transported by the flow of a processing solution, a processor in which a processing solution is splayed onto the light-sensitive material, and a coating type processor in which a processing solution is coated directly or through a gas phase on the light-sensitive material, are suitable to control the using amount of the processing solution at an extremely small amount. Other than the above-mentioned, a web processing method in which a carrier containing a processing solution is contacted to the light-sensitive material, and a method using a viscous processing solution are also applicable. When a large amount of light-sensitive material is processed, the processing is usually run using an automatic processor. In such the case, a less amount of replenishing solution is referable. From the viewpoint of environment suitability, the most preferable procedure is to add a replenisher in a form of tablet. The method described in Kokai Gihou 94-16935 is most preferable.

EXAMPLES

Example 1

A paper support was prepared by laminating a high density polyethylene on the both side of a raw paper having a weight of 180 g/m$^2$. The laminated layer of polyethylene provided on the surface, on which a silver halide emulsion layer to be coated, contained 15% by weight of surface-treated anatase type titanium oxide and the layer is laminated by a melt-coating method. Thus prepared reflective support was subjected to a corona discharge treatment and coated with a gelatin subbing layer. On the subbing layer, the following layers were provided to prepare a light-sensitive material Sample 101. The coating liquids were prepared as the followings.

In 60 ml of ethyl acetate, 23.4 g of yellow dye-forming coupler Y-1, 3.34 g of dye image stabilizing agent ST-1, 3.34 g of dye image stabilizing agent ST-2, 3.34 g of dye image stabilizing agent ST-5, 0.34 g of anti-stain agent HQ-1, 5.0 g of image stabilizing agent A, 3.33 g of high-boiling solvent DBP, and 1.67 g of high-boiling solvent DNP were dissolved, and the solution was emulsified by an ultrasonic homogenizer in 220 ml of a 10% aqueous gelatin solution containing 7 ml of a 20% solution of surfactant SU-1. Thus a yellow dye-forming coupler dispersion was prepared. The dispersion was mixed with a blue-sensitive silver halide emulsion to prepare a coating liquid for the first layer.

Coating liquids for the second through seventh layer were each prepared so that the coating amounts of the compositions thereof were as shown below.

Hardeners H-1 and H-2 were added. Surfactants SU-2 and SU-3 were added as coating aids to control the surface tension of the coating liquid. Compound F-1 was added to each of the layers so that the total amount was 0.04 g/m$^2$.

Seventh layer (protective layer)

| Seventh layer (protective layer) | |
|---|---|
| Gelatin | 1.00 g/m$^2$ |
| DIPD | 0.002 g/m$^2$ |
| DBP | 0.002 g/m$^2$ |
| Silicon dioxide | 0.003 g/m$^2$ |
| **Sixth layer (UV absorbing layer)** | |
| Gelatin | 0.40 g/m$^2$ |
| AI-1 | 0.01 g/m$^2$ |
| UV absorbent UV-1 | 0.12 g/m$^2$ |
| UV absorbent UV-2 | 0.04 g/m$^2$ |
| UV absorbent UV-3 | 0.16 g/m$^2$ |
| Anti-stain agent HQ-5 | 0.04 g/m$^2$ |
| PVP | 0.03 g/m$^2$ |

-continued

| | |
|---|---|
| **Fifth layer (red-sensitive layer)** | |
| Gelatin | 1.30 g/m$^2$ |
| Red-sensitive silver chlorobromide emulsion (Em-R) | 0.21 g/m$^2$ |
| Cyan dye forming coupler C-1 | 0.25 g/m$^2$ |
| Cyan dye forming coupler C-2 | 0.08 g/m$^2$ |
| Dye image stabilizing agent ST-1 | 0.10 g/m$^2$ |
| Anti-stain agent HQ-1 | 0.004 g/m$^2$ |
| DBP | 0.10 g/m$^2$ |
| DOP | 0.20 g/m$^2$ |
| **Fourth layer (UV absorption layer)** | |
| Gelatin | 0.94 g/m$^2$ |
| UV absorbent UV-1 | 0.28 g/m$^2$ |
| UV absorbent UV-2 | 0.09 g/m$^2$ |
| UV absorbent UV-3 | 0.38 g/m$^2$ |
| AI-1 | 0.02 g/m$^2$ |
| Anti-stain agent HQ-5 | 0.10 g/m$^2$ |
| **Third layer (green-sensitive layer)** | |
| Gelatin | 1.30 g/m$^2$ |
| AI-2 | 0.01 g/m$^2$ |
| Green-sensitive silver chlorobromide emulsion (Em-G) | 0.14 g/m$^2$ |
| Magenta dye forming coupler M-1 | 0.20 g/m$^2$ |
| Dye image stabilizing agent ST-3 | 0.20 g/m$^2$ |
| Dye image stabilizing agent ST-4 | 0.17 g/m$^2$ |
| DIDP | 0.13 g/m$^2$ |
| DBP | 0.13 g/m$^2$ |
| **Second layer (interlayer)** | |
| Gelatin | 1.20 g/m$^2$ |
| AI-3 | 0.01 g/m$^2$ |
| Anti-stain agent HQ-2 | 0.03 g/m$^2$ |
| Anti-stain agent HQ-3 | 0.03 g/m$^2$ |
| Anti-stain agent HQ-4 | 0.05 g/m$^2$ |
| Anti-stain agent HQ-5 | 0.23 g/m$^2$ |
| DIDP | 0.04 g/m$^2$ |
| DBP | 0.02 g/m$^2$ |
| Fluorescent whitening agent W-1 | 0.10 g/m$^2$ |
| **First layer (blue-sensitive layer)** | |
| Gelatin | 1.20 g/m$^2$ |
| Blue-sensitive silver chlorobromide emulsion (Em-B) | 0.26 g/m$^2$ |
| Yellow dye forming coupler Y-1 | 0.70 g/m$^2$ |
| Dye image stabilizing agent ST-1 | 0.10 g/m$^2$ |
| Dye image stabilizing agent ST-2 | 0.10 g/m$^2$ |
| Dye image stabilizing agent ST-5 | 0.10 g/m$^2$ |
| Anti-stain agent HQ-1 | 0.01 g/m$^2$ |
| Image stabilizing agent A | 0.15 g/m$^2$ |

-continued

| | |
|---|---|
| DNP | 0.05 g/m$^2$ |
| DBP | 0.15 g/m$^2$ |

Support

Polyethylene laminated paper containing a slight amount of a tinting agent

In the above, the amount of the silver halide emulsion is described in terms of silver.

The compounds used in the above compositions are as follows.

SU-1: Sodium tri-i-propylnaphthalenesulfonate

SU-2: Sodium salt of di(2-ethylhexyl)sulfosuccinate

SU-3: Sodium salt of di(2,2,3,3,4,4,5,5-octafluoro-pentyl sulfosuccinate

DBP: Dibutyl phthalate

DNP: Dinonyl phthalate

DOP: Dioctyl phthalate

DIDP: Di-i-decyl phthalate, Mw=70,000

PVP: Polyvinylpyrrolidone

H-1: Tetrakis(vinylaulfonylmetho)methane

H-2: Sodium salt of 2,4-dichloro-6-hydroxy-s-triazine

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-2,5-di-sec-tetradecyl-hydroquinone

HQ-5 2,5: 2,5-di[(1,1-dimethyl-4-hexyloxycarbonyl) butyl]-hydroquinone

Image stabilizing agent A: p-t-octylphenol

Y-1

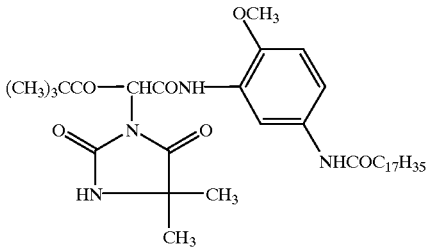

C-1

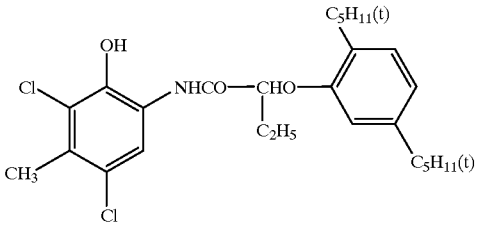

-continued
C-2
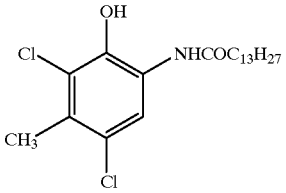
M-1
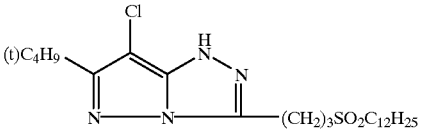
ST-1
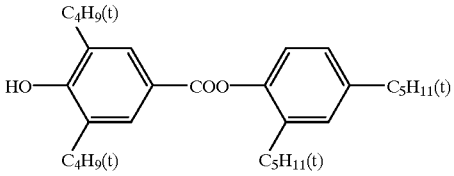
ST-2
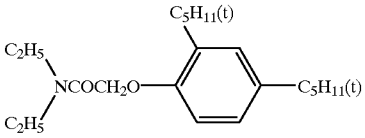
ST-3
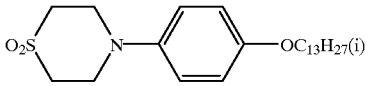
ST-4
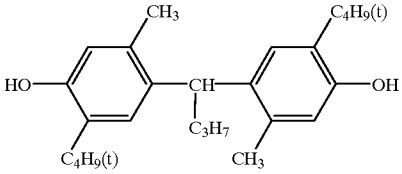
ST-5
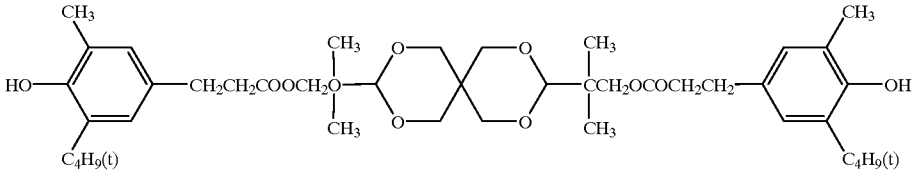
UV-1
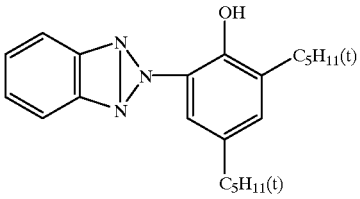
UV-2
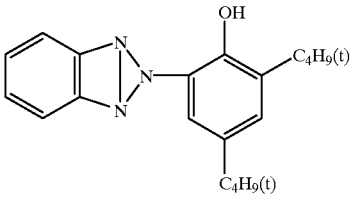
UV-3
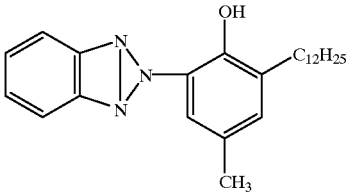
AI-1
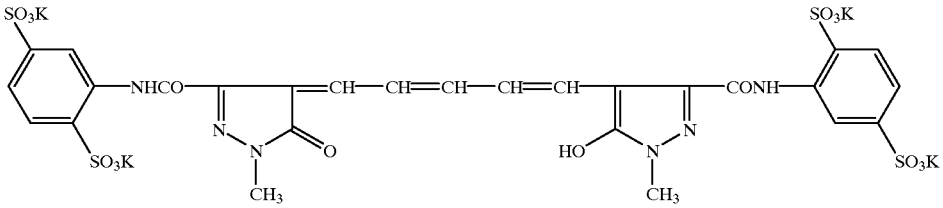

-continued

AI-2

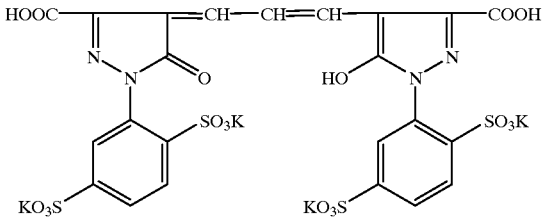

AI-3

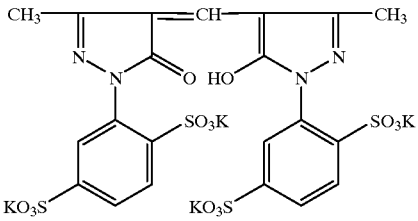

W-1

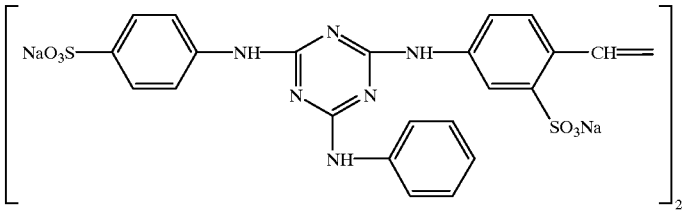

F-1

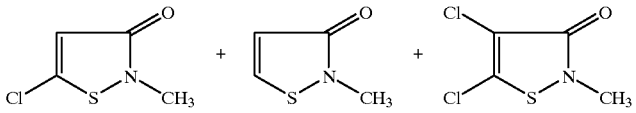

(50%) (46%) (4%)

in molar ratio

Preparation of Blue-sensitive Silver Halide Emulsion

Into 1 liter of 2% aqueous solution of gelatin kept at 40 k C, Solution A and Solution B were simultaneously added spending for 30 minutes while maintaining the pAg and pH at 7.3 and 3.0, respectively. After that, Solution C and Solution D were simultaneously added spending for 180 minutes while maintaining the pAg and pH at 8.0 and 5.5, respectively. Control of the pAg value was carried out by the method described in JP O.P.I. No. 59-45437, and the control of the pH value was performed by the use of a solution of sulfuric acid or that of sodium hydroxide.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| $K_2IrCl_6$ | $4 \times 10^{-8}$ moles/mole Ag |
| $K_4Fe(CN)_6$ | $2 \times 10^{-5}$ moles/mole Ag |
| Potassium bromide | 1.0 g |
| Water to make | 600 ml |
| Solution D | |
| Silver nitrate | 300 g |
| Water to make | 600 ml |

After the addition of the solutions, the obtained emulsion was desalted by using a 5% solution of Demol N, manufactured by Kao-Atlas Co., Ltd., and a 20% solution of magnesium sulfate and mix with a gelatin solution. Thus a monodispersed cubic grain emulsion EMP-1 was prepared, which has an average size of 0.71 μm, a variation coefficient of grain size distribution of 0.07 and a silver chloride content of 99.5 mole-%. On the other hand, a monodisperse cubic grain emulsion EMP-1B was prepared in the same manner as in EMP-1 except that the time for addition of Solutions A and B and that of Solutions C and D were varied. EMP-1B had an average grain size of 0.64 μm, a variation coefficient of grain size distribution of 0.07 and a silver chloride content of 99.5 mole-%.

Emulsions EMP-1 and EMP-1B were each optimally subjected to chemical sensitization at 60° C., and the sensitized EMP-1 and EMP-1B were mixed in a ratio of 1:1 in silver amount. Thus a blue-sensitive silver chlorobromide emulsion Em-B was prepared.

| | |
|---|---|
| Sodium thiosulfate | 0.8 mg/mole of AgX |
| Chloroauric acid | 0.5 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye BS-1 | $4 \times 10^{-4}$ moles/mole of AgX |
| Sensitizing dye BS-2 | $1 \times 10^{-4}$ moles/mole of AgX |

Preparation of Green-sensitive Silver Halide Emulsion

Emulsion EMP-2 was prepared in the same manner as in EMP-1 except that the adding times of Solutions A and B and Solutions C and D were varied. EMP-2 was a monodisperse cubic grain emulsion having an average grain size of 0.40 μm, a variation coefficient of grain size distribution of 0.08 and a silver chloride content of 99.5 mole-%. Then Emulsion EMP-2B was prepared a manner similar to EMP-2. EMP-2B was a monodisperse cubic grain emulsion having an average grain size of 0.50 μm, a variation coefficient of grain size distribution of 0.08 and a silver chloride content of 99.5 mole-%.

Emulsions EMP-2 and EMP-2B were each optimally subjected to chemical sensitization at 55° C., and the sensitized EMP-2 and EMP-2B were mixed in a ratio of 1:1 in silver amount. Thus a green-sensitive silver chlorobromide emulsion Em-G was prepared.

| | |
|---|---|
| Sodium thiosulfate | 1.5 mg/mole of AgX |
| Chloroauric acid | 1.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye GS-1 | $4 \times 10^{-4}$ moles/mole of AgX |

Preparation of Red-Sensitive Silver Halide Emulsion

Emulsion EMP-3 was prepared in the same manner as in EMP-1 except that the adding times of Solutions A and B and Solutions C and D were varied. EMP-2 was a monodisperse cubic grain emulsion having an average grain size of 0.40 $\mu$m, a variation coefficient of grain size distribution of 0.08 and a silver chloride content of 99.5 mole-%. Then Emulsion EMP-2B was prepared a manner similar to EMP-3. EMP-3B was a monodisperse cubic grain emulsion having an average grain size of 0.38 $\mu$m, a variation coefficient of grain size distribution of 0.08 and a silver chloride content of 99.5 mole-%.

Emulsions EMP-3 and EMP-3B were each optimally subjected to chemical sensitization at 60° C., and the sensitized EMP-3 and EMP-3B were mixed in a ratio of 1:1 in silver amount. Thus a green-sensitive silver chlorobromide emulsion Em-R was prepared.

| | |
|---|---|
| Sodium thiosulfate | 1.8 mg/mole of AgX |
| Chloroauric acid | 2.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye RS-1 | $1 \times 10^{-4}$ moles/mole of AgX |
| Sensitizing dye RS-2 | $1 \times 10^{-4}$ moles/mole of AgX |

In the above receipt,

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole

In the red sensitive emulsions, SS-1 was added in an amount of $2.0 \times 10^{-3}$ moles/mole of silver halide.

BS-1

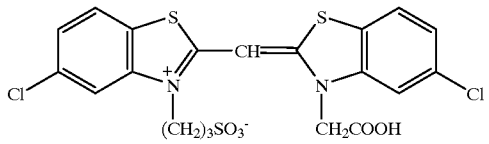

BS-2

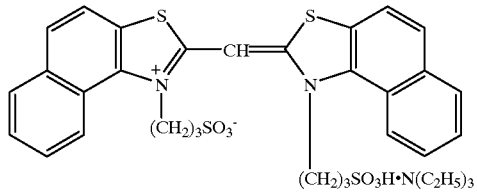

GS-1

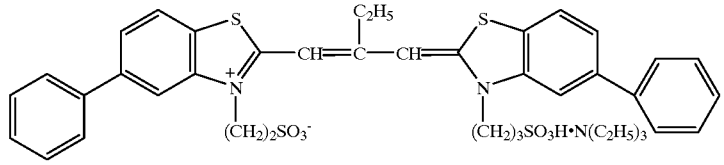

RS-1

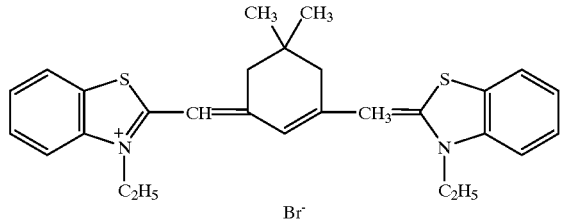

-continued

RS-2

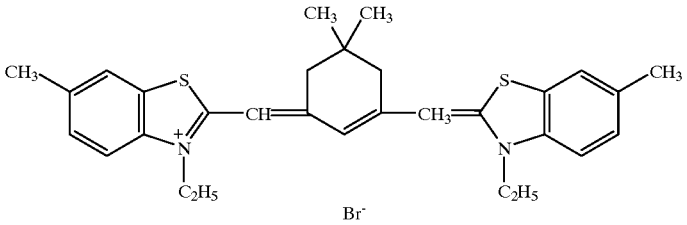

SS-1

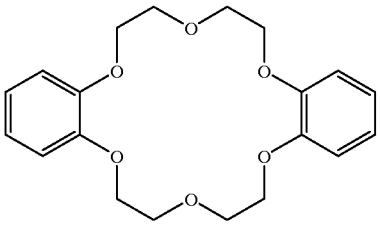

Thus a silver halide photographic light-sensitive material Sample 101 was prepared.

Samples 102 through 124 were prepared in the same manner as in Sample 101 except that the additive in the first and second layers were changed as shown in Table 1.

The color forming efficiency or maximum density, the color fog, the light fastness and the storage stability of the samples were measured according to the following procedures. Color forming efficiency The sample was exposed to light through an optical wedge in an ordinary manner, and processed by the following color developing processes. The maximum density $D_{max}$ of the blue-sensitive emulsion layer of the sample was measured by a densitometer PDA-65, manufactured by Konica Corp.

Color fog

The sample unexposed to light was processed by the following processes and the reflective density $D_{min}$ was measured by a densitometer 310TR, manufactured by X-lite Co., Ltd.

Light fastness

The sample was exposed to light through an optical wedge in an ordinary manner, and processed by the following processes. Thus obtained processed sample was stood for 10 weeks on a exposing stand to exposed to sun light, and the remaining ratio in % of the density of the color image at the area having an initial density of 1.0 for evaluating the light fastness of the image.

Storage ability of raw light-sensitive material

The sample unexposed was stored for 6 days in an atmosphere of a temperature 55° C. and a relative humidity of 40%. After the storage, the samples were treated in the same manner as in the evaluation of color fog. The storage ability was evaluated by the difference ΔDB of the reflective densities of the samples before and after storage.

Color processing procedure

| Color processing procedure | | | |
|---|---|---|---|
| Process | Temperature | Time | Replenishing amount |
| Color development | 38 ± 0.3° C. | 45 sec. | 80 ml/m$^2$ |
| Bleach-fixing | 35 ± 0.5° C. | 45 sec. | 120 ml/m$^2$ |
| Stabilizing | 30–34° C. | 60 sec. | 150 ml/m$^2$ |
| Drying | 60–80° C. | 30 sec. | |

Compositions of the processing solution were as follows.

Color developing solution

| | Tank solution | Replenishing solution |
|---|---|---|
| Color developing solution | | |
| Purified water | 800 ml | 800 ml |
| Triethylenediamine | 2 g | 3 g |
| Diethylene glycol | 10 g | 10 g |
| Potassium bromide | 0.01 g | |
| Potassium chloride | 3.5 g | |
| Potassium sulfite | 0.25 g | 0.5 g |
| N-ethyl-N-(β-methanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriaminepentaacetate | 2.0 g | 2.0 g |
| Fluorescent whitening agent (4,4'-diamino-stylbene-disulfonic acid derivative) | 2.0 g | 2.5 g |
| Potassium carbonate | 30 g | 30 g |

-continued

| | | |
|---|---|---|
| Water to make | 1 l | 1 l |
| Adjust pH to | 10.10 | 10.60 |
| Bleach-fixing tank solution and replenishing solution | | |
| Ammonium ferric diethylenetriaminepenta-acetate dihydrate | 65 g | |
| Diethylenetriaminepentaacetic acid | 3 g | |
| Ammonium thiosulfate (70% aqueous solution) | 100 ml | |
| 2-amino-5-mercapto-1,3,4-diazole | 2.0 g | |
| Ammonium sulfite (40% aqueous solution) | 27.5 ml | |
| Water to make | 1 l | |
| Adjust pH to 5.0 by potassium carbonate or glacial acetic acid | | |
| Stabilizing tank solution and replenishing solution | | |
| o-phenylphenol | 1.0 g | |
| 5-chloro-2-methyl-4-isothiazoline-3-one | 0.02 g | |
| 2-methyl-4-isothiazoline-3-one | 0.02 g | |
| Diethylene glycol | 1.0 g | |
| Fluorescent whitening agent (Cinopar SFP) | 2.0 g | |
| 1-hydroxyethylidene-1,1-disulfonic acid | 1.8 g | |
| Bismuth chloride (45% aqueous solution) | 0.65 g | |
| Magnesium sulfate heptahydrate | 0.2 g | |
| PVP | 1.0 g | |
| Ammonia water (25% aqueous solution of ammonium hydroxide) | 2.5 g | |
| Trisodium nitrylotriacetate | 1.5 g | |
| Water to make | 1 l | |
| Adjust pH to 7.5 by sulfuric acid or ammonia water | | |

weight of the yellow dye forming coupler. The amount of the compound having the unit represented by Formula II or polyvinylpyrrolidone added to the second layer was $5.0\times 10^{-2}$ g/m$^2$.

The added amount of compounds III, IV and VI were each 0.02 millimoles/m$^2$, 0.4 millimoles/m$^2$ and 0.2 millimoles/m$^2$, respectively.

As is shown in Table 1, the samples according to the invention are excellent in all the evaluated items.

Example 2

Samples 201 through 224 each the same as Sample 101 through 124, respectively, were prepared. The samples were evaluated in the same manner as in Example 1 except that the processing was changed as follows.

A processing apparatus was used in which the thickness of the space for processing was about 2.5 mm and the volume of a processing solution contained in the processing space was about 60% of the whole volume of the processing solution. The processing was carried out under the following conditions.

| Process | Temperature | Time | Replenishing amount |
|---|---|---|---|
| Color development | 42.0 ± 0.3° C. | 7 sec. | 65 ml/m$^2$ |

TABLE 1

| Sample No. | 1st layer Yellow coupler | Polymer P | Compound III | Compound IV | Compound VI | 2nd layer Compound II | Color forming efficiency (Dmax) | Fog (Dmin) | Light-fastness ΔDB % | ΔDG % | ΔDR % | Storage ability of raw light-sensitive material (ΔDmin) |
|---|---|---|---|---|---|---|---|---|---|---|---|---|
| 101 | Y-1 | — | — | — | — | — | 2.08 | 0.018 | 69 | 65 | 77 | 0.007 |
| 102 | I-18 | — | — | — | — | — | 2.10 | 0.020 | 64 | 63 | 75 | 0.011 |
| 103 | I-18 | P-2 | — | — | — | — | 2.01 | 0.015 | 77 | 68 | 78 | 0.007 |
| 104 | I-18 | — | — | — | — | PVP | 2.10 | 0.021 | 67 | 65 | 75 | 0.008 |
| 105 | I-18 | P-2 | — | — | — | PVP | 2.12 | 0.012 | 80 | 71 | 78 | 0.004 |
| 106 | I-18 | P-10 | — | — | — | PVP | 2.11 | 0.013 | 78 | 70 | 77 | 0.005 |
| 107 | I-5 | P-2 | — | — | — | PVP | 2.09 | 0.01i | 82 | 71 | 77 | 0.004 |
| 108 | I-1 | P-2 | — | — | — | PVP | 2.10 | 0.013 | 79 | 71 | 78 | 0.005 |
| 109 | I-24 | P-2 | — | — | — | PVP | 2.09 | 0.010 | 82 | 72 | 78 | 0.004 |
| 110 | I-18 | P-2 | III-30 | — | — | — | 2.12 | 0.013 | 78 | 71 | 77 | 0.006 |
| 111 | I-18 | P-2 | III-30 | — | — | PVP | 2.14 | 0.01D | 78 | 70 | 76 | 0.003 |
| 112 | I-18 | P-2 | III-22 | — | — | — | 2.10 | 0.914 | 79 | 70 | 77 | 0.006 |
| 113 | I-18 | P-2 | — | IV-21 | — | — | 2.11 | 0.013 | 79 | 75 | 77 | 0.005 |
| 114 | I-18 | P-2 | — | IV-22 | — | — | 2.10 | 0.014 | 79 | 76 | 79 | 0.005 |
| 115 | I-18 | P-2 | — | IV-21 | — | PVP | 2.12 | 0.011 | 80 | 75 | 78 | 0.003 |
| 116 | I-18 | P-2 | III-30 | IV-21 | — | PVP | 2.15 | 0.010 | 80 | 76 | 78 | 0.003 |
| 117 | I-18 | P-2 | — | — | VI-16 | — | 2.05 | 0.020 | 82 | 70 | 77 | 0.007 |
| 118 | I-18 | P-2 | — | — | VI-16 | PVP | 2.11 | 0.013 | 83 | 72 | 78 | 0.005 |
| 119 | I-18 | P-2 | — | — | VI-17 | PVP | 2.12 | 0.012 | 81 | 71 | 77 | 0.004 |
| 120 | I-18 | P-2 | III-30 | — | VI-16 | — | 2.14 | 0.014 | 82 | 72 | 77 | 0.005 |
| 121 | I-18 | P-2 | — | IV-21 | VI-16 | — | 2.12 | 0.013 | 83 | 76 | 78 | 0.004 |
| 122 | I-18 | P-2 | — | IV-21 | VI-16 | PVP | 2.12 | 0.011 | 82 | 76 | 78 | 0.004 |
| 123 | I-18 | P-2 | III-30 | IV-21 | VI-16 | PVP | 2.15 | 0.010 | 83 | 76 | 77 | 0.003 |
| 124 | I-24 | P-2 | III-30 | IV-21 | VI-16 | PVP | 2.13 | 0.009 | 85 | 77 | 78 | 0.002 |

In each of Samples 102 through 123, the yellow dye forming couplers shown in Table 1 were each used in the same molar amount as that of Y-1 in Sample 101. The polymer compound was added in an amount of 20% by -continued

| Process | Temperature | Time | Replenishing amount |
|---|---|---|---|
| Bleach-fixing | 38.0 ± 0.5° C. | 7 sec. | 60 ml/$m^2$ |
| Stabilizing | 30–34° C. | 16 sec. | 120 ml/$m^2$ |
| Drying | 60–80° C. | 15 sec. | |

The following processing solutiions were used.

| | Tank solution | Replenishing solution |
|---|---|---|
| Color developing solution | | |
| Purified water | 800 ml | 800 ml |
| Diethylene glycol | 15 g | 15 g |
| Potassium bromide | 0.02 g | 0.008 g |
| Potassium chloride | 3 g | 0.3 g |
| Potassium sulfite | $5.0 \times 10^{-4}$ moles | $7.0 \times 10^{-4}$ moles |

-continued

| | | |
|---|---|---|
| N-ethyl-N-(β-methanesulfonamido-ethyl)-3-methyl-4-aminoaniline sulfate | 8.0 g | 15.0 g |
| N,N-bis(sulfoethyl)hydroxylamine | 6.0 g | 6.0 g |
| Sodium diethylenetriaminepenta-acetate | 5.0 g | 7.5 g |
| Sodium p-toluenesulfonate | 15.0 g | 15.0 g |
| Potassium carbonate | 33 g | 30 g |
| Water to make | 1 l | 1 l |
| Adjust pH to | 10.10 | 10.40 |
| Bleach-fixing solution | | |
| Ammonium ferric ethylenedia-minesuccinate | 0.20 moles | 0.32 moles |

-continued

| | | |
|---|---|---|
| Ethylenediaminesuccinic acid | 0.02 moles | 0.032 moles |
| Ammonium thiosulfate | 0.65 moles | 1.04 moles |
| Ammonium sulfite | 0.12 moles | 0.192 moles |
| Water to make | 1 l | 1 l |
| Adjust pH by potassium carbonate or glacial acetic acid to | 6.0 | 5.0 |
| Stabilizing tank solution and replenishing solution | | |
| o-phenylphenol | 0.1 g | |
| Fluorescent whitening agent (Cinopar SFP) | 1.0 g | |
| $ZnSO_4.7H_2O$ | 0.1 g | |
| 1-hydroxyethylidene-1,1-disulfonic acid (60% aqueous solution) | 3.0 g | |
| Ethylenediaminetetraacetic acid | 1.5 g | |
| Ammonium sulfite (40% aqueous solution) | 5.0 ml | |
| Water to make | 1 l | |
| Adjust pH to 7.8 by sulfuric acid or ammonia water | | |

TABLE 2

| Sample No. | 1st layer Yellow coupler | Polymer P | Compound III | Compound IV | Compound VI | 2nd layer Compound II | Color forming efficiency (Dmax) | Fog (Dmin) | Light-fastness ΔDB % | ΔDG % | ΔDR % | Storage ability of raw light-sensitive material (ΔDmin) |
|---|---|---|---|---|---|---|---|---|---|---|---|---|
| 201 | Y-1 | — | — | — | — | — | 1.99 | 0.023 | 67 | 61 | 76 | 0.010 |
| 202 | I-18 | — | — | — | — | — | 2.01 | 0.025 | 60. | 57 | 75 | 0.015 |
| 203 | I-18 | P-2 | — | — | — | — | 2.08 | 0.017 | 76 | 67 | 77 | 0.007 |
| 204 | I-18 | — | — | — | — | PVP | 2.04 | 0.023 | 62 | 56 | 73 | 0.010 |
| 205 | I-18 | P-2 | — | — | — | PVP | 2.10 | 0.014 | 79 | 70 | 78 | 0.006 |
| 206 | I-18 | P-10 | — | — | — | PVP | 2.11 | 0.014 | 76 | 70 | 77 | 0.005 |
| 207 | I-5 | P-2 | — | — | — | PVP | 2.08 | 0.013 | 80 | 71 | 76 | 0.004 |
| 208 | I-1 | P-2 | — | — | — | PVP | 2.07 | 0.012 | 77 | 70 | 78 | 0.006 |
| 209 | I-24 | P-2 | — | — | — | PVP | 2.07 | 0.013 | 81 | 71 | 78 | 0.005 |
| 210 | I-18 | P-2 | III-30 | — | — | — | 2.10 | 0.014 | 78 | 69 | 76 | 0.006 |
| 211 | I-18 | P-2 | III-30 | — | — | PVP | 2.12 | 0.013 | 76 | 68 | 76 | 0.004 |
| 212 | I-18 | P-2 | III-22 | — | — | — | 2.08 | 0.015 | 78 | 70 | 75 | 0.006 |
| 213 | I-18 | P-2 | — | IV-21 | — | — | 2.09 | 0.016 | 79 | 73 | 77 | 0.006 |
| 214 | I-18 | P-2 | — | IV-22 | — | — | 2.09 | 0.016 | 78 | 75 | 77 | 0.005 |
| 215 | I-18 | P-2 | — | IV-21 | — | PVP | 2.11 | 0.014 | 78 | 73 | 78 | 0.005 |
| 216 | I-18 | P-2 | III-30 | IV-21 | — | PVP | 2.14 | 0.012 | 79 | 76 | 76 | 0.004 |
| 217 | I-18 | P-2 | — | — | VI-16 | — | 2.07 | 0.018 | 80 | 69 | 77 | 0.006 |
| 218 | I-18 | P-2 | — | — | VI-16 | PVP | 2.09 | 0.016 | 82 | 70 | 76 | 0.005 |
| 219 | I-18 | P-2 | — | — | VI-17 | PVP | 2.10 | 0.014 | 80 | 71 | 75 | 0.006 |
| 220 | I-18 | P-2 | III-30 | — | VI-16 | — | 2.13 | 0.015 | 79 | 71 | 77 | 0.006 |
| 221 | I-18 | P-2 | — | IV-21 | VI-16 | — | 2.12 | 0.015 | 82 | 75 | 76 | 0.006 |
| 222 | I-18 | P-2 | — | IV-21 | VI-16 | PVP | 2.11 | 0.014 | 80 | 76 | 77 | 0.004 |
| 223 | I-18 | P-2 | III-30 | IV-21 | VI-16 | PVP | 2.12 | 0.013 | 81 | 74 | 77 | 0.004 |
| 224 | I-24 | P-2 | III-30 | IV-21 | VI-16 | PVP | 2.12 | 0.012 | 82 | 76 | 78 | 0.004 |

As is shown in Table 2, the effects of the invention are obtained when the above-mentioned processing is applied.

Example 3

Samples 301 through 323 each the same as Sample 101 through 123 were prepared. The samples were evaluated in the same manner as in Example 1 except that the processing was changed as follows.

A processor for coating development was used, in which the first part on the surface of the light-sensitive material heated by a heating device arranged in the developing apparatus and then the second part of developing solution was supplied onto the light-sensitive material surface so as to perform the color development. The second part of the developing solution was supplied after 0.5 seconds the supply of the first part.

The processing conditions and the processing solutions were as follows.

| Process | Temperature | Time | Replenishing amount |
|---|---|---|---|
| Color development | 80° C. | 7 sec. | 40 ml/m$^2$ |
| Bleach-fixing | 38.0 ± 0.5° C. | 7 sec. | 60 ml/m$^2$ |
| Stabilizing | 30–34° C. | 16 sec. | 120 ml/m$^2$ |
| Drying | 60–80° C. | 15 sec. | |

First part of developing solution

| | |
|---|---|
| Purified water | 500 ml |
| Sodium sulfite | 1.0 g |

-continued

| | |
|---|---|
| Pentasodium diethylenetriaminepentaacetate | 3.0 g |
| p-toluenesulfonic acid | 20.0 g |
| N-ethyl-N-(β-methanesulfonamidoethyl)-3-methyl-4-aminoaniline sulfate | 43.0 g |
| Water to make | 1 l |
| Adjust pH to 2.0 by potassium hydroxide of 50% sulfuric acid | |

Second part of developing solution

| | |
|---|---|
| Purified water | 500 ml |
| Potassium chloride | 10.0 g |
| Pentasodium diethylenetriaminepentaacetate | 3.0 g |
| Potassium carbonate | 82.0 g |
| p-toluenesulfonic acid | 15.0 g |
| Water to make | 1 l |
| Adjust pH to 13.5 by potassium hydroxide of 50% sulfuric acid | |

Thus obtained results are shown in Table 3.

TABLE 3

| Sample No. | 1st layer Yellow coupler | Poly-mer P | Compound III | Compound IV | Compound VI | 2nd layer Compound II | Color forming efficiency (Dmax) | Fog (Dmin) | Light-fastness ΔDB % | ΔDG % | ΔDR % | Storage ability of raw light-sensitive material (ΔDmin) |
|---|---|---|---|---|---|---|---|---|---|---|---|---|
| 301 | Y-1 | — | — | — | — | — | 2.01 | 0.025 | 75 | 62 | 77 | 0.011 |
| 302 | I-18 | — | — | — | — | — | 2.03 | 0.026 | 60 | 58 | 76 | 0.015 |
| 303 | I-18 | P-2 | — | — | — | — | 2.08 | 0.016 | 78 | 67 | 78 | 0.008 |
| 304 | I-18 | — | — | — | — | PVP | 2.07 | 0.019 | 61 | 58 | 75 | 0.009 |
| 305 | I-18 | P-2 | — | — | — | PVP | 2.10 | 0.015 | 79 | 69 | 78 | 0.006 |
| 306 | I-18 | P-10 | — | — | — | PVP | 2.12 | 0.014 | 77 | 71 | 76 | 0.006 |
| 307 | I-5 | P-2 | — | — | — | PVP | 2.09 | 0.015 | 79 | 70 | 77 | 0.005 |
| 308 | I-1 | P-2 | — | — | — | PVP | 2.08 | 0.014 | 76 | 69 | 78 | 0.006 |
| 309 | I-24 | P-2 | — | — | — | PVP | 2.09 | 0.013 | 80 | 70 | 78 | 0.005 |
| 310 | I-18 | P-2 | III-30 | — | — | — | 2.10 | 0.014 | 78 | 70 | 77 | 0.005 |
| 311 | I-18 | P-2 | III-30 | — | — | PVP | 2.13 | 0.015 | 77 | 69 | 76 | 0.005 |
| 312 | I-18 | P-2 | III-22 | — | — | — | 2.10 | 0.015 | 78 | 70 | 75 | 0.006 |
| 313 | I-18 | P-2 | — | IV-21 | — | — | 2.09 | 0.016 | 79 | 74 | 76 | 0.006 |
| 314 | I-18 | P-2 | — | IV-22 | — | — | 2.11 | 0.016 | 78 | 74 | 77 | 0.006 |
| 315 | I-18 | P-2 | — | IV-21 | — | PVP | 2.11 | 0.015 | 79 | 73 | 77 | 0.005 |
| 316 | I-18 | P-2 | III-30 | IV-21 | — | PVP | 2.13 | 0.014 | 79 | 75 | 76 | 0.005 |
| 317 | I-18 | P-2 | — | — | VI-16 | — | 2.08 | 0.017 | 81 | 69 | 77 | 0.007 |
| 318 | I-18 | P-2 | — | — | VI-16 | PVP | 2.09 | 0.016 | 82 | 68 | 76 | 0.005 |
| 319 | I-18 | P-2 | — | — | VI-17 | PVP | 2.10 | 0.015 | 80 | 69 | 77 | 0.006 |
| 320 | I-18 | P-2 | III-30 | — | VI-16 | — | 2.12 | 0.015 | 79 | 73 | 76 | 0.006 |
| 321 | I-18 | P-2 | — | IV-21 | VI-16 | — | 2.12 | 0.016 | 81 | 75 | 77 | 0.007 |
| 322 | I-18 | P-2 | — | IV-21 | VI-16 | PVP | 2.11 | 0.014 | 80 | 75 | 76 | 0.005 |
| 323 | I-18 | P-2 | III-30 | IV-21 | VI-16 | PVP | 2.13 | 0.014 | 82 | 74 | 78 | 0.004 |
| 324 | I-24 | P-2 | III-30 | IV-21 | VI-16 | PVP | 2.12 | 0.013 | 83 | 75 | 77 | 0.004 |

As is shown in Table 3, the effects of the invention are obtained when the above-mentioned processing is applied.

Example 4

The color forming efficiency and the storage ability of raw light-sensitive material of the samples were evaluated in the same manner as in Example 1 except that the samples were processed by a printer-processor QPD-1500A, manufactured by Konica Corporation, using processing chemicals ECOJET-HQA-B according to CPK-HQA process, manufactured by Konica Corporation. The effects of the invention were observed by the test.

What is claimed is:

1. A silver halide photographic light sensitive material comprising a support having thereon a yellow dye image-forming light-sensitive silver halide emulsion layer, a magenta dye image-forming light-sensitive silver halide emulsion layer, and a cyan dye image-forming light-sensitive silver halide emulsion layer and optionally a light-insensitive layer, in which said yellow image-forming light-sensitive silver halide emulsion layer contains a yellow dye-forming coupler represented by Formula I and an organic solvent-soluble polymer, and a light-sensitive or light-insensitive layer each adjoined to the yellow image-forming silver halide emulsion layer contains a polymer which have a constituting unit represented by Formula II;

Formula I

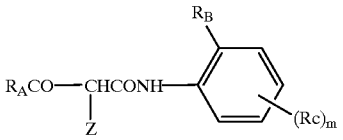

wherein $R_A$ is an alkyl group or a cycloalkyl group, $R_B$ is a halogen atom or an alkoxy group, $R_C$ is a group capable of being a substituent of the benzene group, m is an integer of from 0 to 40, plural $R_c$s may be the same or different when m is 2 or more, and Z is a group capable of being released upon reaction with the oxidation product of a color developing agent, Formula II

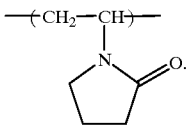

2. The light-sensitive material of claim 1, wherein said yellow dye-forming coupler represented by Formula I is contained in said yellow dye image-forming light-sensitive silver halide emulsion layer in an amount of from $0.06\times10^{-3}$ moles/m$^2$ to $1.00\times10^{-3}$ moles/m$^2$.

3. The light-sensitive material of claim 1, wherein said organic solvent-soluble polymer is contained in said yellow dye image-forming light-sensitive silver halide emulsion layer in a weight ratio of from 1:20 to 20:1 to said yellow dye-forming coupler contained in said yellow image forming silver halide emulsion layer.

4. The light-sensitive material of claim 1, wherein said polymer having a constituting unit represented by Formula II is contained in said yellow dye image-forming light-sensitive silver halide emulsion layer in an amount of from 10 mg/m$^2$ to 100 mg/m$^2$.

5. The light-sensitive material of claim 1, wherein said polymer having a constituting unit represented by Formula II is polyvinylpyrrolidone.

6. The light-sensitive material of claim 1, wherein said yellow dye image-forming silver halide emulsion layer further contains a fluorine-containing surfactant represented by Formula III, or a compound represented by Formula V dispersed in a gelatin solution with a surfactant represented Formula V;

Formula III $$(Cf)—(Y)_n$$

wherein Cf is an n-valent group having three or more fluorine atoms and two or more carbon atoms, Y is a —COOM group, an —$SO_3M$ group, an —$OSO_3$ group or a —P(=O) $(OM)_2$ group in which M is a cation, and n is an integer of 1 or 2;

Formula IV

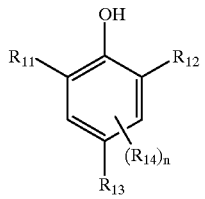

wherein $R_{11}$, $R_{12}$ and $R_{13}$ are each independently a hydrogen atom, or an unsubstituted alkyl group, provided that at least one of $R_{11}$, $R_{12}$ and $R_{13}$ is the alkyl group, and $R_{14}$ is an unsubstituted alkyl group or a halogen atom, and n is an integer of 1 or 2, when n is 2 two $R_{14}$s may be the same or different;

Formula V $$(C_1)—(Y)_n$$

wherein $C_1$ is a n-valent group having at least 2 two or more atoms, and Y is a —COOM group, an —$SO_3M$ group, an —$OSO_3M$ group or a —P(=O) $(OM)_2$ group in which M is a cation, and n is an integer of 1 or 2.

7. The light-sensitive material of claim 6, wherein said compound represented by Formula III is contained in said yellow dye image-forming silver halide emulsion layer in an amount of from 0.05 mg/m$^2$ to 1000 mg/m$^2$.

8. The light-senitive material of claim 6, wherein said compound represented by Formula IV is contained in said yellow dye image-forming silver halide emulsion layer in an amount of from $1\times10^{-2}$ moles to 5 moles per mole of said yellow dye-forming coupler represented by Formula I contained in said yellow dye image-forming silver halide emulsion layer.

9. The light-sensitive material of claim 1, wherein said yellow dye image forming silver halide emulsion layer contains a compound represented by Formula VI;

Formula VI

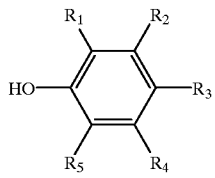

wherein $R_1$ is a tertiary alkyl group, $R_2$ is a primary or secondary alkyl group, and $R_3$, $R_4$ and $R_5$ are each a an alkyl group, an alkoxycarbonyl group, a phenoxycarbonyl group, an alkoxy group or a phenylthio group.

10. The light-sensitive material of claim 9, wherein said compound represented by Formula IV is contained in said yellow dye image-forming silver halide emulsion layer in an amount of from $0.03\times10^{-3}$ moles/$m^2$ to $0.5\times10^{-3}$ moles/$m^2$.

* * * * *